US007837401B2

(12) United States Patent
Sugiura

(10) Patent No.: US 7,837,401 B2
(45) Date of Patent: Nov. 23, 2010

(54) IMAGE FORMING APPARATUS

(75) Inventor: Toshio Sugiura, Anjo (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 729 days.

(21) Appl. No.: 11/679,362

(22) Filed: Feb. 27, 2007

(65) Prior Publication Data

US 2007/0201930 A1 Aug. 30, 2007

(30) Foreign Application Priority Data

Feb. 27, 2006 (JP) ..... 2006-050474

(51) Int. Cl.
*B41J 11/22* (2006.01)
*B41J 23/32* (2006.01)
*B41J 23/36* (2006.01)

(52) U.S. Cl. ..... 400/354; 400/352; 400/283

(58) Field of Classification Search ..... 400/55, 400/59, 320, 323, 635; 347/37
See application file for complete search history.

(56) References Cited

U.S. PATENT DOCUMENTS

| | | | | |
|---|---|---|---|---|
| 4,573,368 | A * | 3/1986 | Kobayashi | 74/108 |
| 5,678,936 | A * | 10/1997 | Hino | 400/55 |
| 6,443,552 | B1 | 9/2002 | Inoue et al. | 347/37 |
| 2005/0001875 | A1 | 1/2005 | Ueda et al. | |
| 2005/0243125 | A1 | 11/2005 | Ishikawa | |
| 2007/0081203 | A1 | 4/2007 | Matsuyama et al. | |

FOREIGN PATENT DOCUMENTS

| | | | |
|---|---|---|---|
| JP | S59-173164 | A | 11/1984 |
| JP | H01-072358 | A | 5/1989 |
| JP | H08-300768 | A | 11/1996 |
| JP | H09-234926 | A | 9/1997 |
| JP | 2001071463 | | 3/2001 |
| JP | 20013084505 | | 12/2001 |
| JP | 2002178586 | | 6/2002 |
| JP | 2004-322538 | A | 11/2004 |
| JP | 2004-345187 | A | 12/2004 |
| JP | 2005-313492 | A | 11/2005 |

OTHER PUBLICATIONS

Japan Patent Office; Notice of Reasons for Rejection in Japanese Patent Application No. 2006-050474 (counterpart to the above-captioned U.S. patent application) mailed Dec. 15, 2009.

* cited by examiner

*Primary Examiner*—Judy Nguyen
*Assistant Examiner*—Marissa L Ferguson-Samreth
(74) *Attorney, Agent, or Firm*—Baker Botts, LLP

(57) ABSTRACT

A multifunction apparatus includes a belt drive mechanism configured to move a carriage reciprocally placed on guide rails. The belt drive mechanism is comprised of a drive pulley, a driven pulley, and a timing belt, which is stretched between the drive pulley and the driven pulley. The carriage includes a belt holder, which is configured to hold the timing belt, and a torsion coil spring, which is configured to urge elastically the belt holder to the carriage. The belt holder is disposed in a position to urge the carriage to one of the guide rail, and movable toward the guide rail relative to the carriage.

7 Claims, 27 Drawing Sheets

IMAGE FORMING APPARATUS

CROSS REFERENCE TO RELATED APPLICATION

This application claims priority from Japanese Patent Application No. 2006-050474, filed Feb. 27, 2006, the entire subject matter of which is incorporated herein by reference.

BACKGROUND OF THE INVENTION

1. Field of the Invention

The invention relates to an image forming apparatus comprising a guide rail comprising a guide surface extending in a predetermined direction, a carriage disposed on the guide surface of the guide rail, a recording head mounted on the carriage, and a belt drive mechanism comprising a timing belt and configured to cause the timing belt to move in order to reciprocally move the carriage along the guide surface.

2. Description of Related Art

A known inkjet-type image forming apparatus records an image on a recording medium by selectively ejecting ink droplets from a recording head onto the recording medium. The recording head is mounted on a carriage, which is supported by a guide rail and a guide shaft and moved reciprocally in a direction perpendicular to a direction in which a recording medium is fed (hereinafter referred to as "a medium feeding direction"). While the carriage is moved reciprocally, the ink droplets are ejected selectively from the recording head onto the recording medium.

The carriage is moved reciprocally by a belt drive mechanism having a timing belt. For example, the timing belt may be stretched between two pulleys, and the timing belt may be connected to the carriage. The pulleys may be driven by a drive source, such as a motor, and rotated. Receiving the rotational driving force of the pulleys, the timing belt may be driven continuously about the two pulleys. Thus, the carriage fixed on the timing belt may be moved reciprocally on the guide rails.

FIG. 26 is a schematic view of a carriage 202 to be moved reciprocally on a guide rail 201. Guide rail 201 is a flat plate having a substantially horizontal upper surface, and supports carriage 202 in such a manner that guide rail 201 reciprocates carriage 202. Pulleys 203 and 204 are disposed at either ends of guide rail 201, and a timing belt 205 extends therebetween. Carriage 202 has a holding portion 206 that holds timing belt 205. Thus, carriage 202 is connected to timing belt 205, and moved reciprocally on guide rail 201 by circumferential movement of the timing belt 205 about pulleys 203 and 204.

As shown in FIG. 26, there is a height difference H between the height of timing belt 205 at pulleys 203 and 204 and the height of timing belt 205 at holding portion 206. In particular, holding portion 206 holds timing belt 205 at a position higher only by difference H than pulleys 203 and 204. Thus, at holding portion 206, tension is applied upwardly to timing belt 205, this tension acts vertically, thereby preventing carriage 202 from being urged toward guide rail 201 and lifted from guide rail 201 during reciprocal movement.

As shown in FIG. 27, even when the carriage 202 is moved to pulley 203, difference H is unchanged. Nevertheless, compared with that carriage 202 is located substantially centrally between pulleys 203 and 204, a distance from pulley 203 to holding portion 206 is reduced, and the angle of inclination of timing belt 205 changing from the height at pulley 203 to the height of holding portion 206 becomes increased. Thus, the urging force applied vertically due to the tension of timing belt 205 increases near pulley 203 or 204 when compared with the urging force at the substantially central position between pulleys 203 and 204. Namely, when carriage 202 is located near pulley 203 or 204, friction between timing belt 205 and pulley 203 or 204 increases. As a result, timing belt 205 may become worn on one side.

The torque of motor to rotate pulleys 203 and 204 is set based on a location at which friction is increased, i.e., based on when carriage 202 is located near pulley 203 or 204. When the friction between pulley 203 or 204 and timing belt 205 and the friction between guide rail 201 and carriage 202 increases, a motor with significant torque is required. To reduce the friction when carriage 202 is located near pulley 203 or 204, pulleys 203 and 204 may be disposed at positions away from the ends of travel between which carriage 202 is moved reciprocally, in order to extend the distance from pulley 203 to holding portion 206. Nevertheless, in this case, a width of the apparatus in a direction in which carriage 202 is moved reciprocally may be increased, thereby preventing or inhibiting a reduction in the size of the apparatus.

SUMMARY OF THE INVENTION

An embodiment of the invention provides an image forming apparatus in which a carriage is moved reciprocally on a guide rail by a belt drive mechanism, and may prevent an urging force applied vertically near the pulley due to a tension of the timing belt from increasing.

According to the image forming apparatus of the invention, the belt holding portion is configured to move toward the guide surface of the guide rail relative to the carriage body, and is urged elastically toward the carriage body by the urging member. Thus, when a relatively strong tension of the timing belt acts on the belt holding portion, the belt holding portion is moved toward the guide surface against the urging force of the urging member, and the tension of the timing belt is decreased. In this manner, the generation of excessive strong tension of the timing belt is prevented when the carriage is located near the drive pulley and the driven pulley, so that the timing belt is prevented from being worn out on one side (i.e., from being worn unevenly). In addition, the carriage may be moved close to the drive pulley or driven pulley, so that the width of the image forming apparatus in the direction in which the carriage is moved reciprocally may be reduced.

Further objects, features, and advantages of the present invention will be understood from the following detailed description of preferred embodiments of the present invention with reference to the accompanying drawings.

BRIEF DESCRIPTION OF THE DRAWINGS

Embodiments of the invention now are described with reference to the accompanying drawings, which are given by way of example only, and are not intended to limit the present invention.

DETAILED DESCRIPTION OF PREFERRED EMBODIMENTS

An embodiment of the invention is described in detail with reference to the accompanying drawings.

Figure 1:
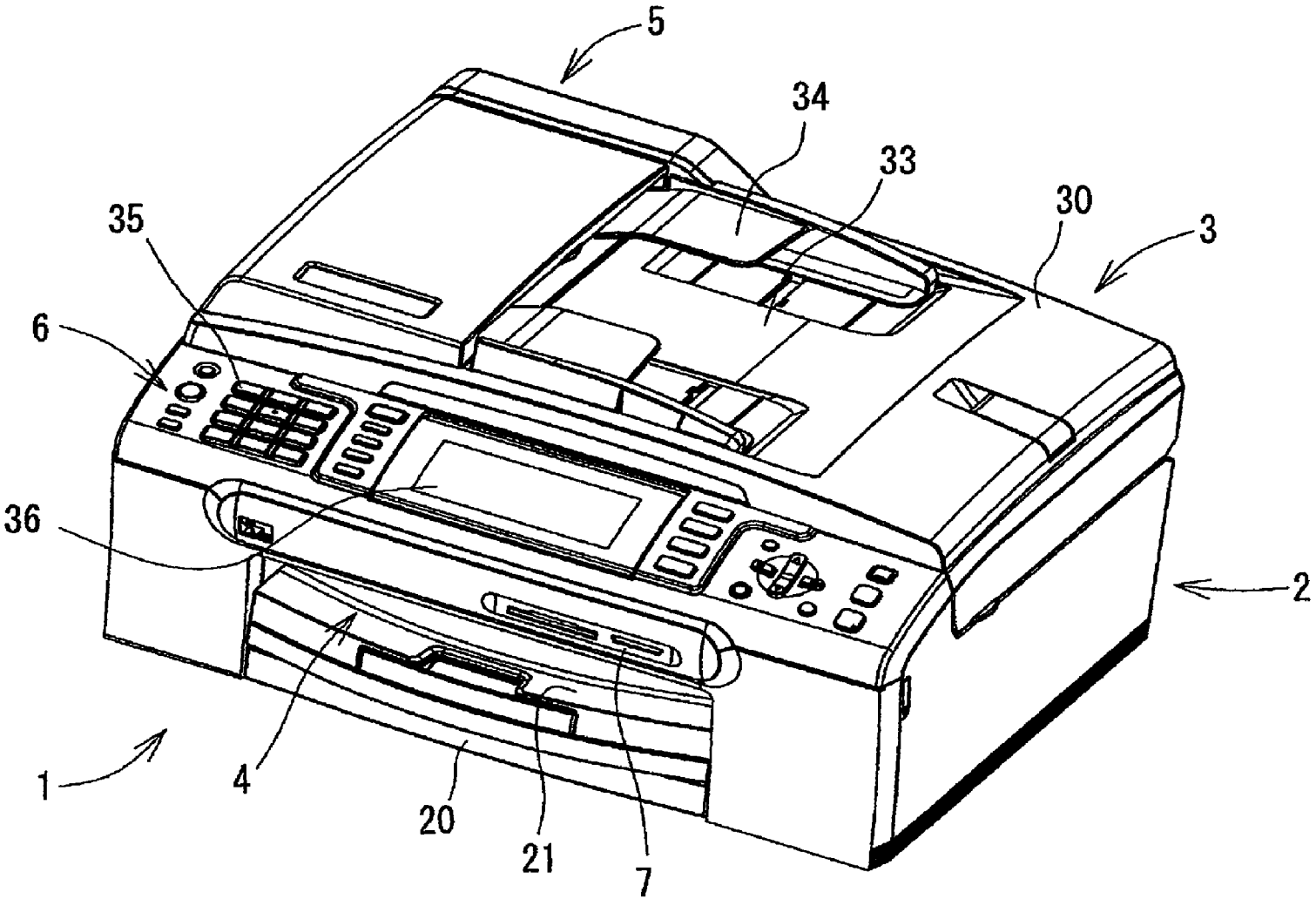
FIG. 1 is a perspective view of a multifunction apparatus according to an embodiment of the invention.

As shown in FIG. 1, a multifunction apparatus 1 integrally comprises a printer portion 2 in a lower portion, and a scanner portion 3 in an upper portion. The multifunction apparatus comprises a printer function, a scanner function, a copy function, and a facsimile function. In multifunction apparatus 1, printer portion 2 corresponds to an image forming apparatus of the invention, and other functions, except for the printer function, are optional. Thus, the invention may be applied to a single-function printer without scanner portion 3, the facsimile function, or the copy function.

For the printer function, multifunction apparatus 1 may be connected to a computer (not shown), so that printer portion 2 records images and texts on recording mediums based on image data and text data sent from the computer. Printer portion 2 records image data output from an external device, such as a digital camera connected to multifunction apparatus 1. Printer portion 2 also records image data stored in a storage medium, such as a memory card inserted into multifunction apparatus 1, onto recording mediums.

For the scanner function, image data of the recording medium (e, a document) read by scanner portion 3 may be sent to the computer. The image data may be stored in a storage medium, such as a memory card. For the copy function, the image data read by scanner portion 3 is recorded onto recording medium by printer portion 2. For the facsimile function, the image data read by scanner portion 3 may be faxed via telephone line or wirelessly. The received facsimile data is recorded on a recording medium by printer portion 2.

As shown in FIG. 1, multifunction apparatus 1 may have a substantially rectangle solid shape with a broad, low profile in which a width and a depth are greater than a height. The lower portion of multifunction apparatus 1 is printer portion 2. Printer portion 2 is formed with an opening 4 in its front. Inside opening 4, an input tray 20 and an output tray 21 are disposed vertically in tiers. Input tray 20 is configured to receive and store a stack of recording mediums, such as paper or plastic sheets, in a substantially horizontal orientation. Input tray 20 is configured to receive and store recording mediums whose size is less than A4 size, such as B5 size and postcard size. Although not shown in FIG. 1, input tray 20 is slidable toward the front to extend and uncover its tray surface. Extended input tray 20 is configured to store legal-sized recording mediums. A recording medium stored in input tray 20 is supplied to the inside of printer portion 2, a desired image is recorded, and then is ejected to output tray 21.

Figure 2:
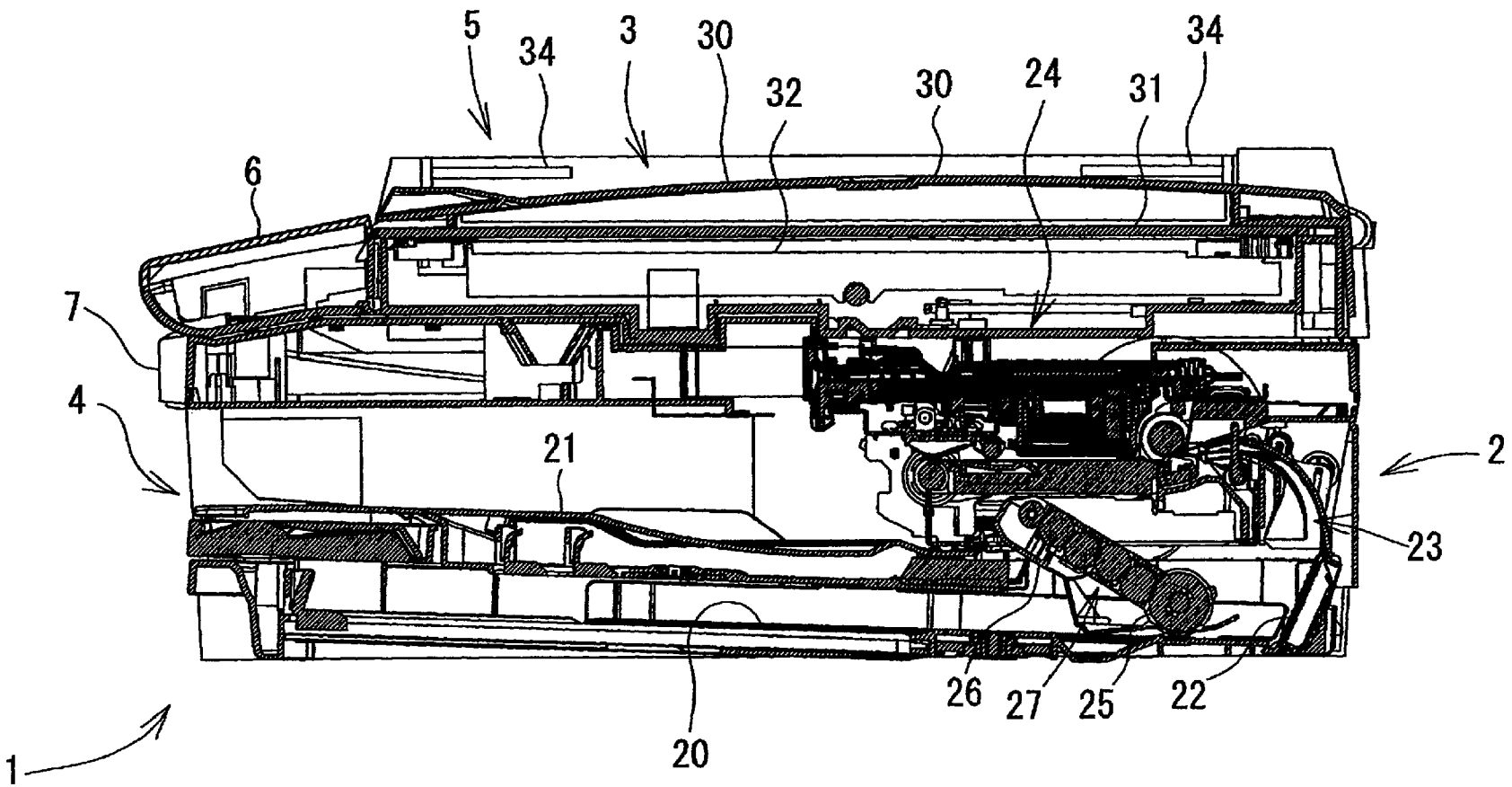
FIG. 2 is a cross-sectional view showing a structure of the multifunction apparatus.

The upper portion of multifunction apparatus 1 is scanner portion 3. Scanner portion 3 may be a flat bed scanner. As shown in FIGS. 1 and 2, a platen glass 31 and an image sensor 32 are disposed under a document cover 30 pivotally provided as a top plate of multifunction apparatus 1. A document whose image is to be read is placed on platen glass 31. Image sensor 32 is disposed under platen glass 31 so as to be moved reciprocally in a width direction of multifunction apparatus 1 (or in a direction perpendicular to the sheet of FIG. 2).

Document cover 30 is provided with an automatic document feeder (ADF) 5. ADF 5 is configured to feed documents successively from a document tray 33 via a document feed path (not shown) to output tray 34. During a feeding process by ADF 5, each document is fed onto platen glass 31, and an image of the document is read by image sensor 32. In this embodiment of the invention, scanner portion 3 and ADF 5 are optional, and, thus, not directly related to the invention. Thus, detailed description thereof is omitted here.

In an upper portion of the front of multifunction apparatus 1, an operation panel 6 is provided. Operation panel 6 includes operation buttons 35 and a liquid crystal display (LCD) 36. Multifunction apparatus 1 is actuated based on an operation instruction from operation panel 6. When multifunction apparatus 1 is connected to an external computer, multifunction apparatus 1 may be actuated based on an instruction sent from the computer via a printer driver or a scanner driver.

On the front side of multifunction apparatus 1, a slot portion 7 is provided. Various compact memory cards, which are storage mediums, may be inserted into slot portion 7. When a predetermined operation is performed on operation panel 6, image data stored in a compact memory card inserted into slot portion 7 is read. Information regarding the read image data is displayed on LCD 36, a selected image based on the operation one of operation buttons 35 is recorded on the recording medium by printer portion 2.

An internal structure of multifunction apparatus 1, especially a structure of printer portion 2, now is described with reference to the drawings. As shown in FIG. 2, input tray 20 disposed on a bottom portion of multifunction apparatus 1 is provided with a separation plate 22. Separation plate 22 is disposed on the rear side of input tray 20, such that separation plate 22 inclines to the rear side of the apparatus. Separation plate 22 is configured to separate a recording medium from a stack of recording mediums supplied from input tray 20 and guide the recording medium to an upper portion. In the upper portion of input tray 20, a medium feed path 23 is formed. Feed path 23 curves upward from separation plate 22, turning to the front side, extending from the rear side to the front side of multifunction apparatus 1, passing through an image recording unit 24, and communicating with output tray 21. The recording medium stored in input tray 20 is inverted upward in medium feed path 23 in such a manner to make a U-turn, guided to image recording unit 24, in which an image is recorded onto the recording medium, and then ejected to output tray 21.

Figure 3:
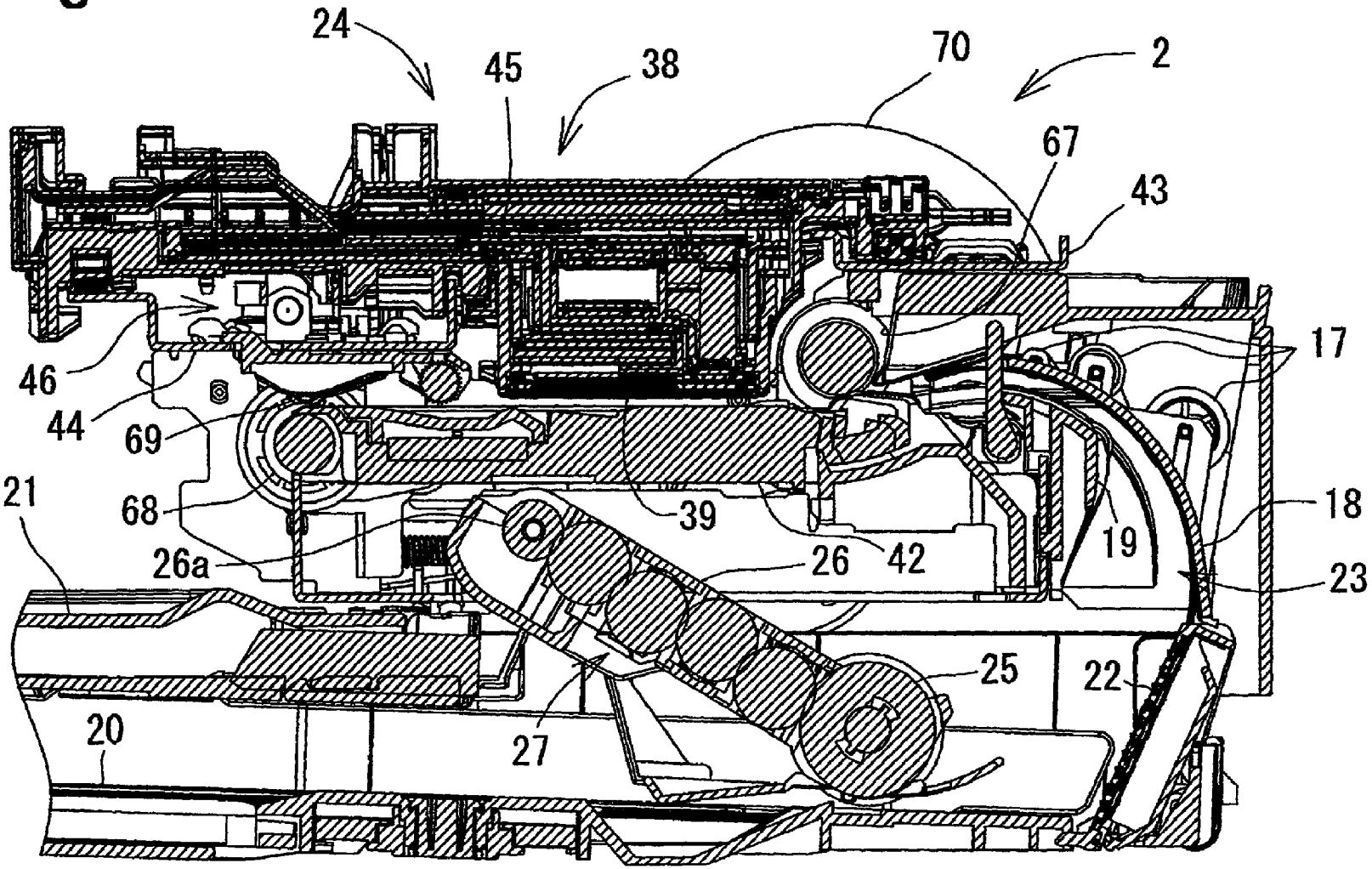
FIG. 3 is an enlarged cross-sectional view showing components significant to the operation of a printer portion.

As shown in FIG. 3, a pick-up roller 25 is disposed above input tray 20. Pick-up roller 25 is configured to contact a recording medium stored in input tray 20 and feed the recording medium to separation plate 22. Pick-up roller 25 is supported at an end of an arm 26. Pick-up roller 25 is rotated by a drive force received from an LF motor 78 (FIG. 7), which is transmitted by a drive transmission mechanism 27, which is made up of meshing gears.

Arm 26 is disposed pivotally on a base shaft 26, and vertically moved, such that arm 26 contacts or separates from input tray 20. As shown in FIG. 3, arm 26 pivots downwardly to contact input tray 20 due to its weight, so that pick-up roller 25 is brought into contact with input tray 20. When input tray 20 and output tray 21 are inserted or removed via opening 4, arm 26 is withdrawn upward. When pick-up roller 25 rotates while remaining pressed against the surface of a recording medium on input tray 20, an uppermost recording medium is supplied to separation plate 22 by a frictional force generated between the roller surface of pick-up roller 25 and the surface of the recording medium. The recording medium contacts separation plate 22 at the recording medium's leading end and is guided upward into medium feed path 23. When the uppermost recording medium is supplied by pick-up roller 25, a recording medium immediately under the uppermost recording medium may be supplied together because of friction and static electricity. Nevertheless, the recording medium contacts separation plate 22 and, thus, is prevented from being supplied together with an adjacent recording medium.

Medium feed path 23 comprises an outer guide surface and an inner guide surface, which are disposed in face-to-face (i.e., opposing) relation, except for a place at which image recording unit 24 is disposed. For example, medium feed path 23 provided on rear of multifunction apparatus 1 is structured by fixing an outer guide member 18 and an inner guide member 19 in the frame. Outer guide member 18 is provided with feed rollers 17. Feed rollers 17 are supported rotatably on outer guide member 18, such that their axial direction is aligned in a width direction of medium feed path 23, and their roller surfaces are exposed from outer guide member 18. Feed rollers 17 provide smooth feeding of a recording medium that contacts the outer guide surface at a place at which medium feed path 23 is bent in a U-shape.

Figure 4:
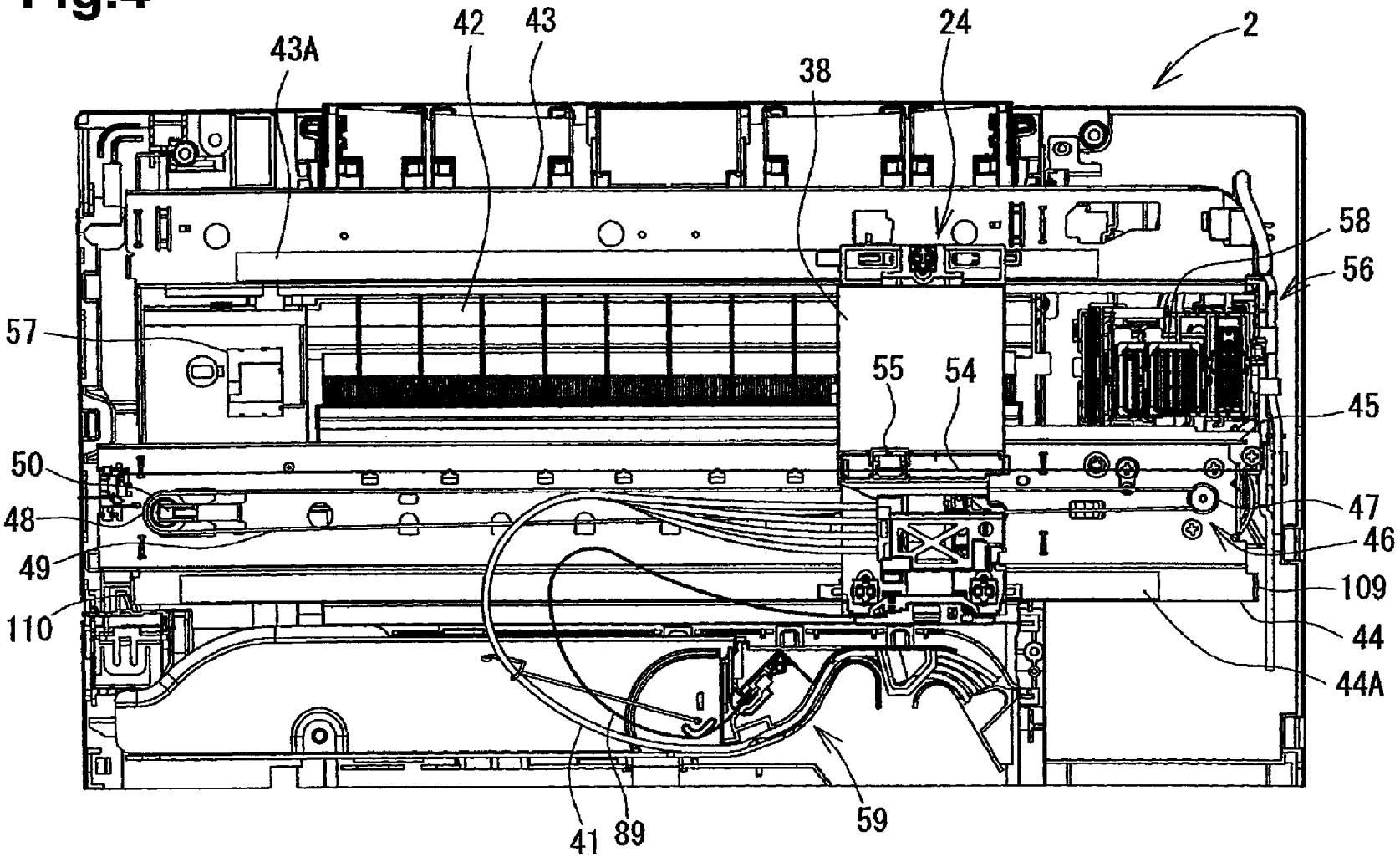
FIG. 4 is an enlarged plan view showing components significant to the operation of the printer portion.

As shown in FIG. 3, image recording unit 24 is disposed in medium feed path 23. Image recording unit 24 comprises a carriage 38 on which a recording head 39 is mounted. Carriage 38 reciprocally moves in the main scanning direction. The detailed description of carriage 38 is provided herein. Recording head 39 is configured to selectively eject ink droplets of ink of each color (e.g., cyan (C), magenta (M), yellow (Y), and black (Bk)), which is supplied from ink cartridges (not shown) provided separately from recording head 39, via ink tubes 41 (FIG. 4). While carriage 38 is moved reciprocally, ink droplets are ejected selectively from recording head 39 on a recording medium being fed on platen 42, and an image is recorded on the recording medium.

FIG. 4 is a plan view showing significant components of printer portion 2. As shown in FIG. 4, a pair of guide rails 43, 44 is disposed in spaced relation to each other, in the medium feeding direction, above medium feed path 23 (FIG. 3). Guide rails 43, 44 extend in a direction perpendicular to the medium feeding direction (e.g., in left-right direction of FIG. 4). Carriage 38 is disposed astride guide rails 43, 44 so as to move reciprocally in a horizontal direction perpendicular to the medium feeding direction. Guide rail 43 is disposed on an upstream side with respect to the medium feeding direction, and has an elongated flat plate shape which is longer than the travel of carriage 38. A part of an upper surface, which is provided on the downstream side with respect to the medium feeding direction, of guide rail 43 is a guide surface 43A. Guide surface 43A slidably supports an upstream end portion of carriage 38.

Guide rail 44 is disposed on a downstream side with respect to the medium feeding direction, and has an elongated flat plate of substantially the same length as guide rail 43. In guide rail 44, an upstream edge portion 45 is bent upward at a substantially right angle. A portion of an upper surface, which is provided on the downstream side with respect to the medium feeding direction, of guide rail 44 is a guide surface 44A. Guide surface 44A slidably supports a downstream end portion of carriage 38. Carriage 38 holds edge portion 45 with rollers or the like, not shown. Thus, carriage 38 is carried slidably on guide surfaces 43A and 44A of guide rails 43 and 44, so that carriage 38 may travel in the horizontal direction perpendicular to the medium feeding direction with reference to edge portion 45 of guide rail 44.

On the upper surface of guide rail 44, a belt drive mechanism 46 is disposed along guide rail 44. Belt drive mechanism 46 is comprised of a drive pulley 47, a driven pulley 48, and an endless timing belt 49 with teeth on its inside surface. Drive pulley 47 and driven pulley 48, respectively, are disposed near other end of guide rail 44 to stretch timing belt 49 therebetween. Timing belt 49 and carriage 38 are connected, so that carriage 38 travels based on movement of belt drive mechanism 46.

Drive pulley 47 is disposed on one end (e.g., right side in FIG. 4) on the upper surface of guide rail 44 to rotate on a shaft, which is disposed in a direction orthogonal to guide surface 44A of guide rail 44 or vertically. Although not shown in FIG. 4, a CR motor 80 (e.g., a drive source in FIG. 7) is disposed under guide rail 44. A drive force is inputted from CR motor 80 to the shaft of drive pulley 47, and, thus, drive pulley 47 is rotated.

Figure 5:
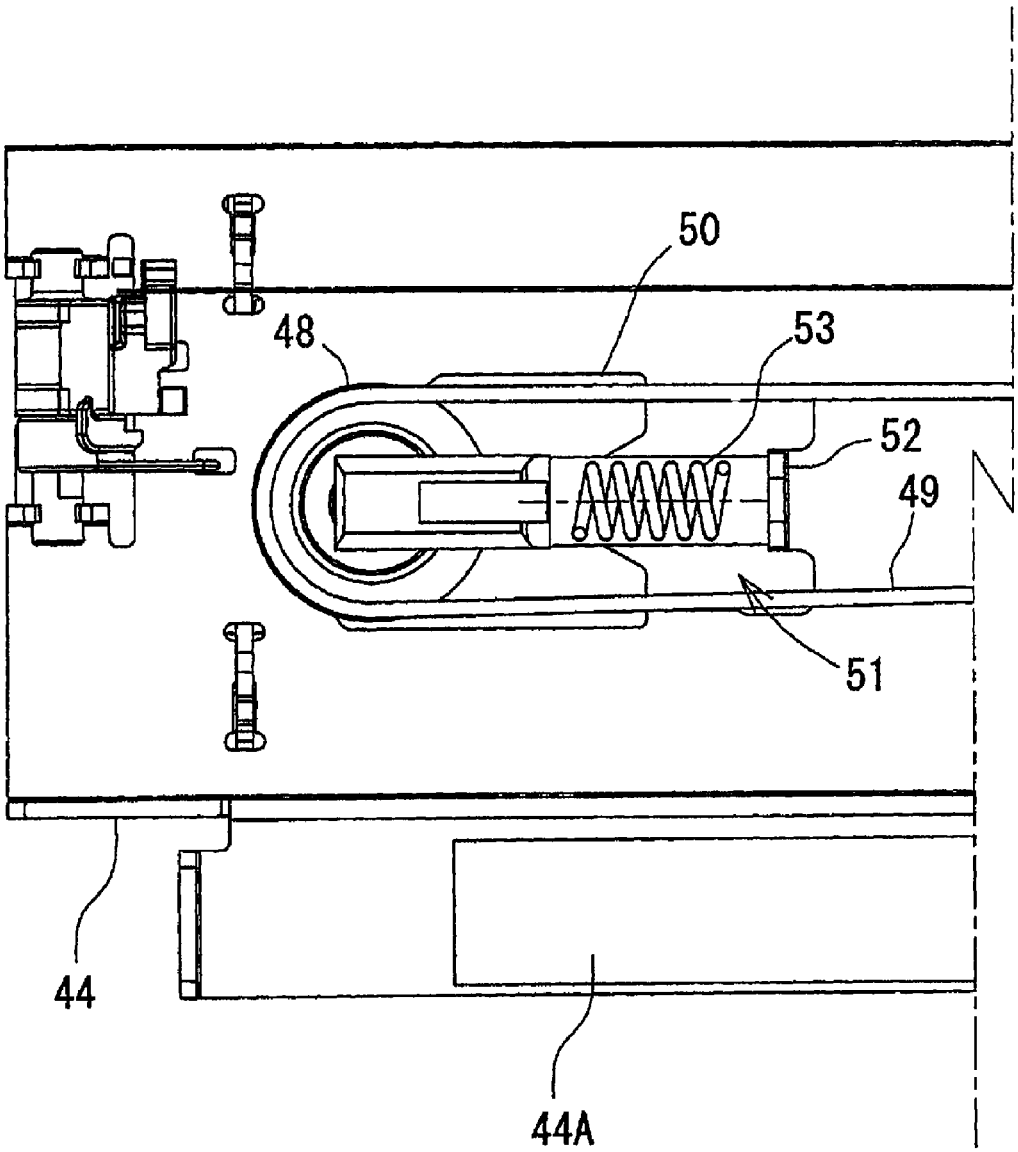
FIG. 5 is an enlarged plan view showing a structure surrounding a driven pulley.

FIG. 5 is an enlarged plan view showing a structure around driven pulley 48. Driven pulley 48 is supported rotatably by a pulley holder 50. Guide rail 44 includes a hole 51 formed at a position at which pulley holder 50 is mounted. When pulley holder 50 is mounted in hole 51, an edge of hole 51 and pulley holder 50 are fitted, and pulley holder 50 is mounted in guide rail 44. In this condition, driven pulley 48 is rotatable on a shaft extending in a direction orthogonal to guide surface 44A of guide rail 44 or vertically.

As shown in FIG. 4, timing belt 49 is stretched between drive pulley 47 and driven pulley 48. Although not shown in FIG. 4, drive pulley 47 has spur teeth on its outer peripheral surface that mesh with the internal teeth of timing belt 49. With this meshing, the rotation of drive pulley 47 is transmitted reliably to timing belt 49, and timing belt 49 is moved circumferentially. As shown in FIG. 5, a coil spring 53 is disposed in compression between pulley holder 50 and a spring supporting portion 52 formed by cutting and raising at the edge of hole 51. Coil spring 52 urges the pulley holder 50 toward the outside of guide rail 44 (e.g., leftward in FIG. 5). Thus, timing belt 49 is held under a moderate tension. In this embodiment, timing belt 49 is continuous. Instead, a timing belt having ends may be used. In this case, both ends of the timing belt may be connected to carriage 38.

Carriage 38 is connected to timing belt 49. When timing belt 49 is moved, carriage 38 travels on guide rails 43 and 44 with reference to edge portion 45. Recording head 39 mounted on carriage 38 is capable of traveling in a width direction of medium feed path 23.

An encoder strip 54 of a linear encoder 84 (FIG. 7) is disposed along the edge portion 45 of guide rail 44. Linear encoder 84 is configured to detect the encoder strip 54 by a photo interrupter 55 mounted on carriage 38. The travel of carriage 38 is controlled based on detection signal from linear encoder 84.

As shown in FIG. 4, platen 42 is disposed facing recording head 39 under medium feed path 23. Platen 42 is disposed in a central portion of the travel of carriage 38 over which a recording medium passes. Platen 42 has a width fully greater than a maximum width of a recording medium multifunction apparatus 1 may handle. Both ends of any recording medium pass over platen 42.

Maintenance units, such as a purge mechanism 56 and a waste ink tray 57, are disposed outside an area in which the recording medium is fed or an image is recorded by recording head 39. Purge mechanism 56 is configured to remove bubbles and foreign matter by suction from nozzles 60 (FIG. 6) disposed on the lower surface of recording head 39. Purge mechanism 56 includes a cap 58. To remove bubbles from the recording head 39, carriage 38 is moved to position recording head 39 above cap 58, cap 58 is moved upward to cover nozzles 60, and ink is drawn from nozzles 60 of recording head 39 by a pump connected to cap 58.

Waste ink tray 57 is configured to receive ink droplets ejected from recording head 39 by a flushing operation. Waste ink tray 57 is formed integrally with platen 42. Maintenance operations are performed by these maintenance units to remove bubbles and mixed ink remaining in recording head 39.

Ink is supplied to recording head 39 via ink tubes 41 connected to ink cartridges not shown for respective colors. Each ink tube 41 is made of a synthetic resin and has flexibility, such that ink tubes 41 bend in accordance with the travel of carriage 38.

Each ink tube 41 is fixed by a fixing clip 59 disposed on an apparatus frame, near a central portion with respect to a width of apparatus 1. In FIG. 4, each ink tube 41 extending from fixing clip 59 toward the ink cartridges is omitted. Because each ink tube 41 is not fixed by fixing clip 59 to carriage 38, ink tubes 41 may move in accordance with the travel of carriage 38.

Figure 6:
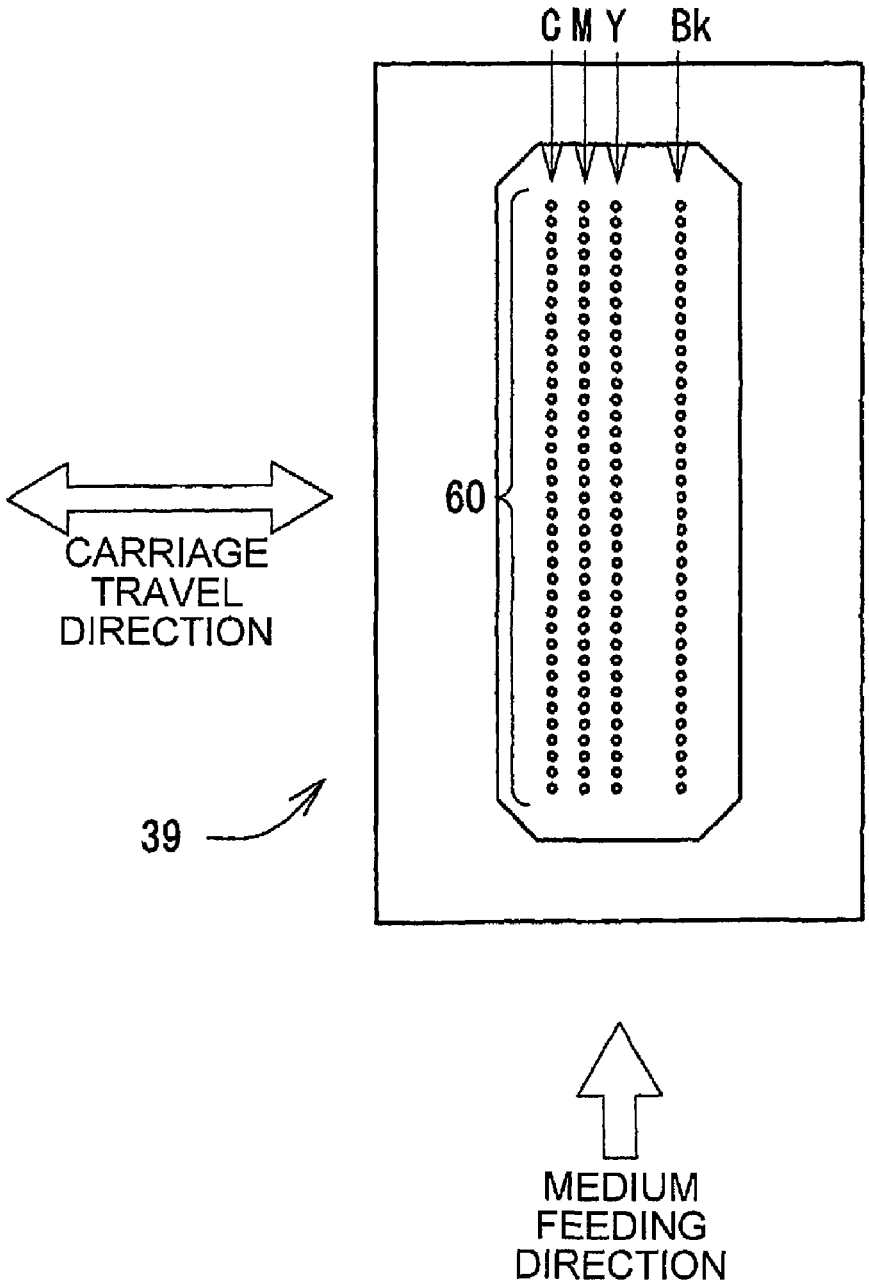
FIG. 6 is a bottom view of a recording head.

FIG. 6 is a bottom view showing a nozzle surface of the recording head 39. As shown in FIG. 6, recording head 39 comprises nozzles 60 at its lower surface. Nozzles 60 are arranged in rows by colors (e.g., cyan (C), magenta (M), yellow (Y), and black (Bk)) in the medium feeding direction. In FIG. 6, an up-down direction is the medium feeding direction, and a left-right direction is a travel direction of carriage 38.

As shown in FIG. 3, a feed roller 67 is disposed upstream of image recording unit 24. Feed roller 67 urges a pinch roller (not shown) disposed opposite feed roller 67. When a recording medium passes between feed roller 67 and the pinch roller, the pinch roller withdraws by the thickness of the recording medium to sandwich the recording medium between the pinch roller and feed roller 67. Thus, the rotation of feed roller 67 is transmitted reliably to the recording medium, and the recording medium is fed onto platen 42.

An ejection roller 68 is disposed downstream of image recording unit 24. A spur roller 69 is disposed opposite ejection roller 68. Spur roller 69 presses against ejection roller 68. Ejection roller 68 and spur roller 69 sandwich and feed the recording medium on which image has been recorded.

A drive force from an LF motor 78 is transmitted to feed roller 67 and ejection roller 68, which are driven intermittently by a predetermined linefeed width. Feed roller 67 and ejection roller 68 are controlled to rotate in synchronization with each other. When a rotary encoder 83 (FIG. 7) disposed on feed roller 67 detects an encoder disk 70 rotating with feed roller 67 by a photo interrupter, feed roller 67 and ejection roller 68 are controlled.

Figure 7:
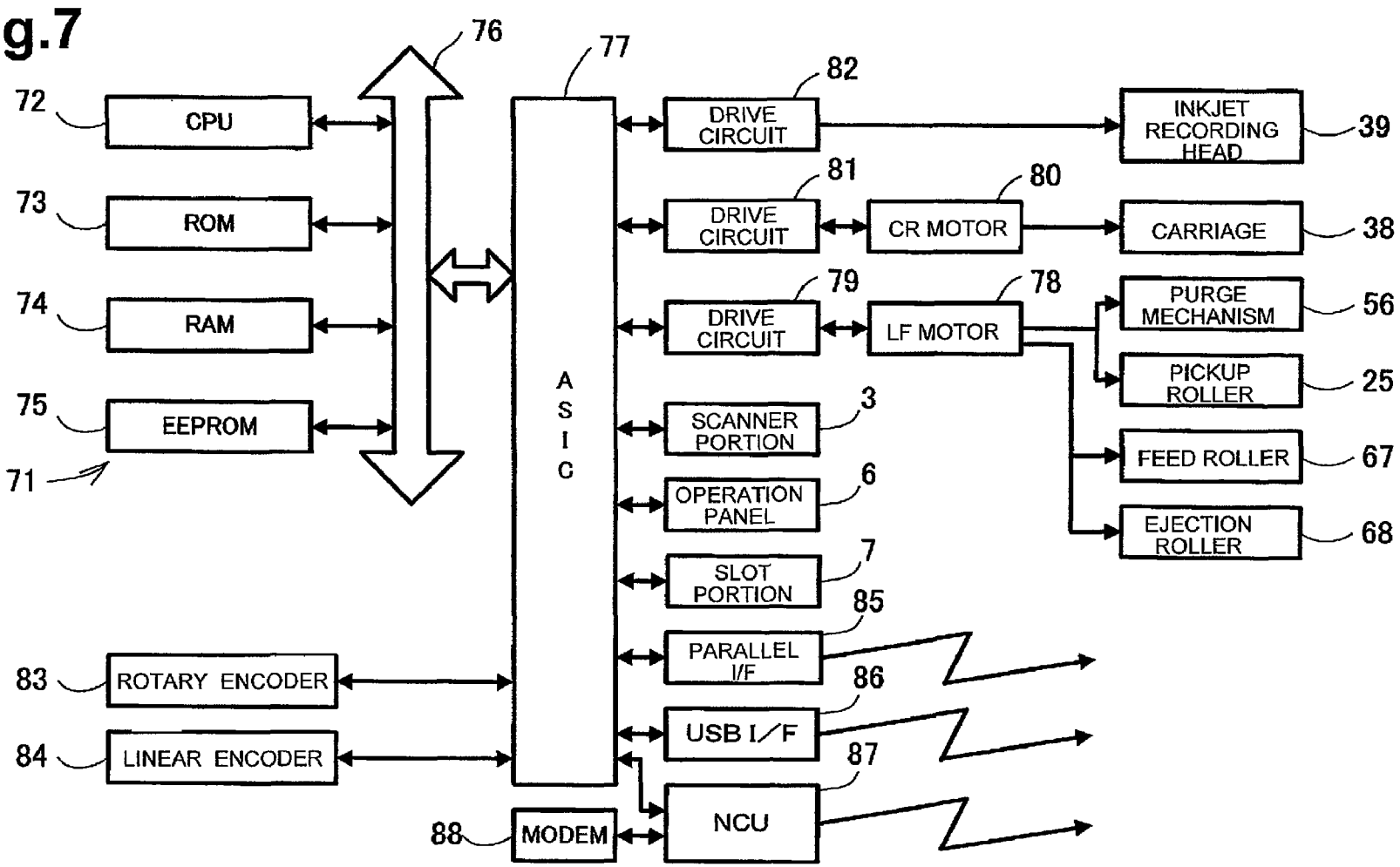
FIG. 7 is a block diagram showing the configuration of a control portion of the multifunction apparatus.

FIG. 7 is a block diagram showing configuration of control part 71 of multifunction apparatus 1. Control part 71 controls all operations of multifunction apparatus 1. Control part 71 is a microcomputer mainly comprised of a central processing unit (CPU) 72, a read only memory (ROM) 73, a random access memory (RAM) 74, and an electrically erasable and programmable ROM (EEPROM) 75, which are connected to an application specific integrated circuit (ASIC) 77 via a bus 76.

ROM 73 stores programs for controlling each operation of multifunction apparatus 1. RAM 74 is used as a memory area or work area that temporarily stores data used when CPU 72 performs the programs. EEPROM 75 stores settings and flags to be maintained even after power off.

ASIC 77 controls the rotation of LF motor 78 by generating an exciting signal to be applied to LF motor 78 in accordance with an instruction from CPU 72 and applying the signal to LF motor 78 via a drive circuit 79 of LF motor 78.

Drive circuit 79 is configured to drive LF motor 78 connected to pick-up roller 25, feed roller 67, ejection roller 67, and purge mechanism 56. Drive circuit 79 receives an output signal from ASIC 77 and forms an electrical signal to rotate LF motor 78. On the receipt of the electrical signal, LF motor 78 rotates, the rotation of LF motor 78 is transmitted, via a known drive mechanism comprised of a gear and a drive shaft, to pick-up roller 25, feed roller 67, ejection roller 67, and purge mechanism 56.

ASIC 77 controls the rotation of CR motor 80 by generating an exciting signal to be applied to CR motor 80 in accordance with an instruction from CPU 72 and applying the signal to CR motor 80 via a drive circuit 81 of CR motor 80.

Drive circuit 81 is configured to drive CR motor 80 which is connected to carriage 38. Drive circuit 80 receives an output signal from ASIC 77 and generates an electrical signal to rotate CR motor 80. On the receipt of the electrical signal, CR motor 80 rotates, rotation of the CR motor 80 is transmitted to carriage 38 via belt drive mechanism 46, and, thus, carriage 38 travels. With this configuration, the travel of carriage 38 is controlled by control part 71.

ASIC 77 is connected to rotary encoder 83 that is configured to detect rotation amount of feed roller 67, and a linear encoder 84 that is configured to detect the travel of carriage 38. ASIC 77 also is connected to operation panel 6 for operations relating to multifunction apparatus 1, slot portion 7 in which a compact memory card is inserted, a parallel interface 85 and a USB interface 86 for transmission and reception of data with an external device, such a personal computer, via a parallel cable or a USB cable. ASIC 77 also is connected to a network control unit (NCU) 87 and a modem 88 for realizing the facsimile function.

Control part 71 comprises of a main circuit board (not shown). Signals for recording are transmitted via a flat cable 89 (FIG. 4) from the main circuit board to recording head 39. Flat cable 89 is a thin belt-like insulation member made by covering a conductor that transmits electrical signals with a film made of a synthetic resin, such as a polyester. Flat cable 89 electrically connects the main circuit board and a control circuit board (not shown) of recording head 39.

Figure 8:
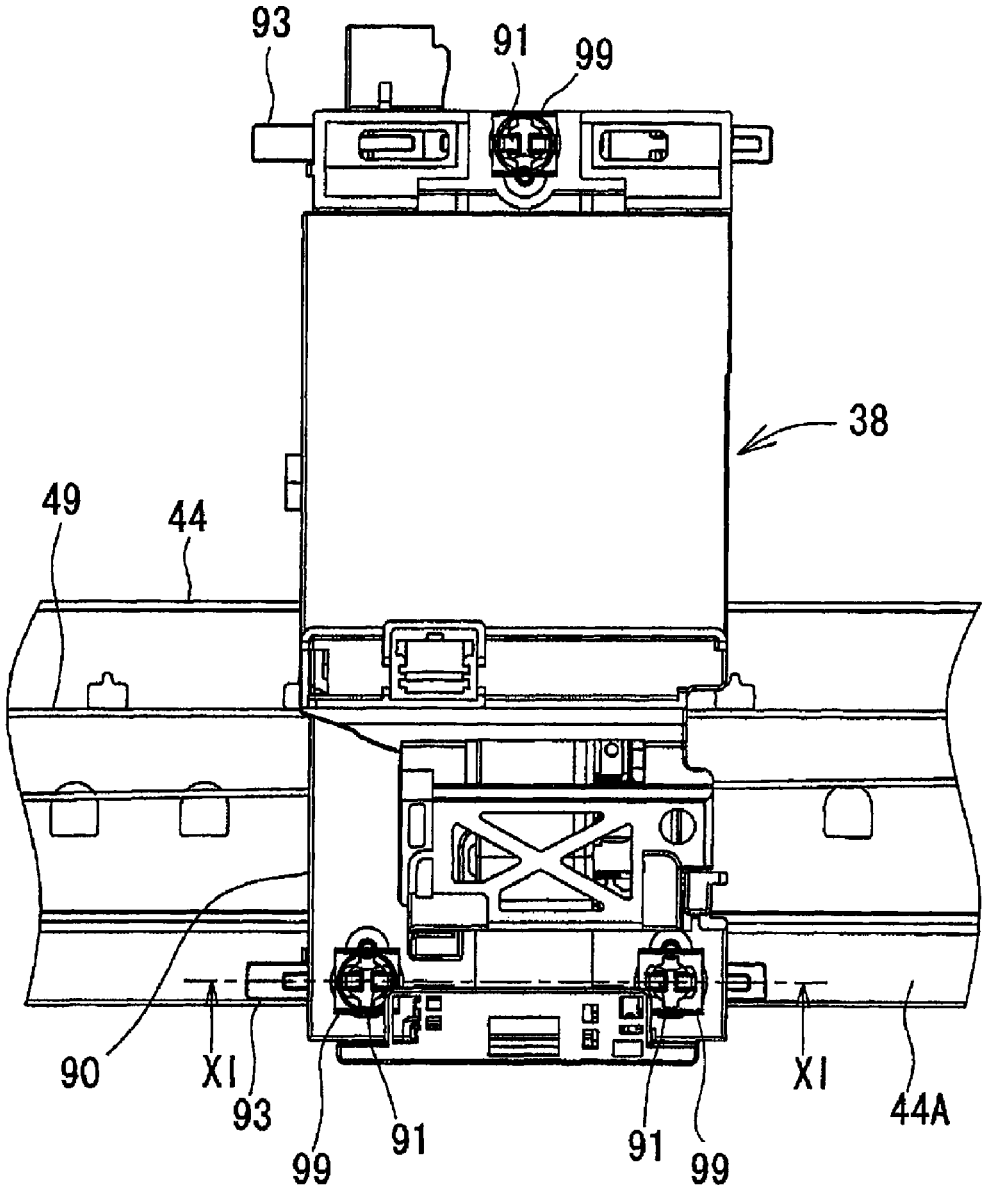
FIG. 8 is an enlarged plan view of a carriage.

A structure of carriage 38 is described below with reference to FIGS. 8-15. In FIG. 8, a guide rail 43 is not depicted. In FIGS. 9-15, guide rails 43 and 44 are not depicted.

Figure 9:
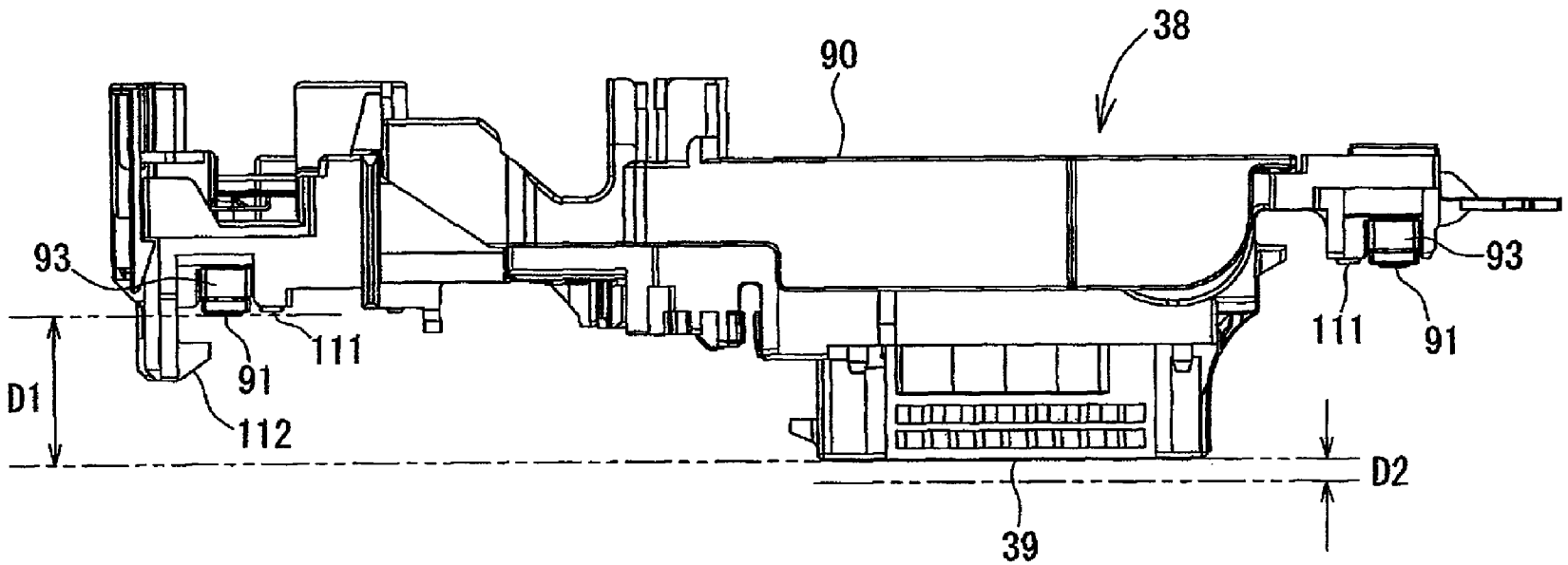
FIG. 9 is a right side view of the carriage.
Figure 10:
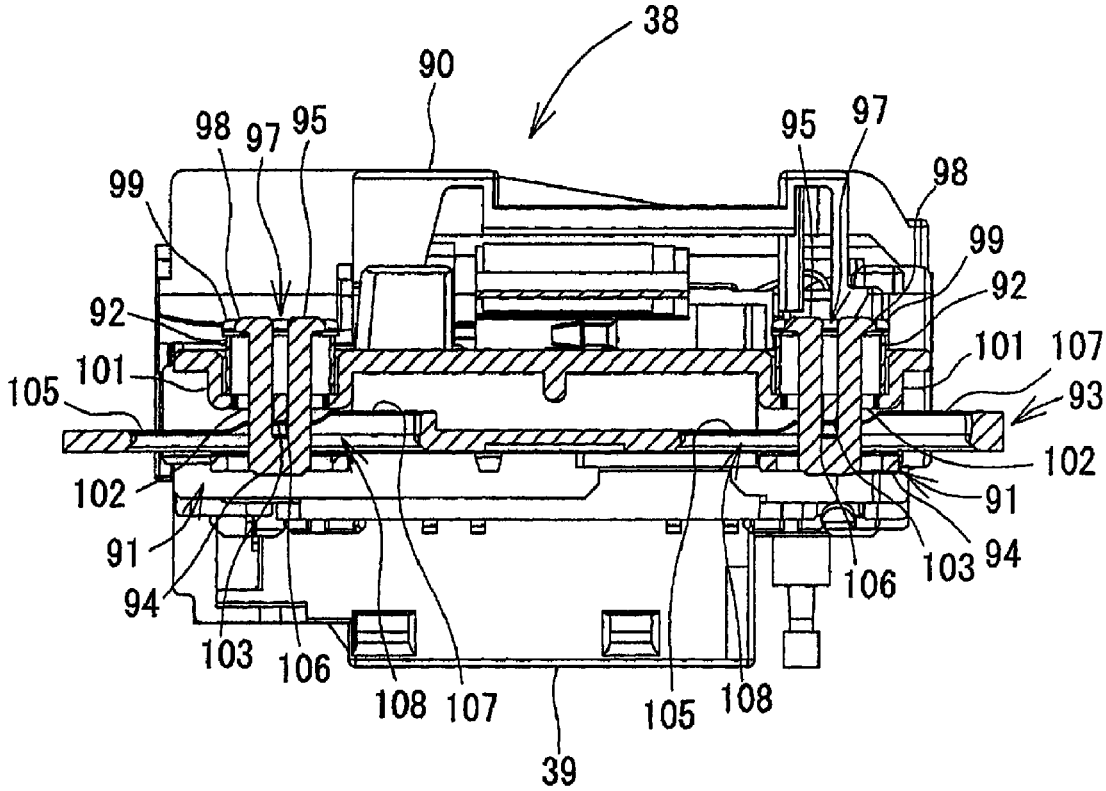
FIG. 10 is a cross-sectional view of the carriage taken along a line XI-XI of FIG. 8.

As shown in FIGS. 8-10, carriage 38 comprises a carriage body 90, sliding members 91, coil springs 92, and gap adjusting members 93. Recording head 39 is mounted on carriage body 90. Sliding members 91 are configured to contact reliably guide rails 43, 44 and support carriage 90 at a predetermined height. Coil springs 92 (e.g., urging members) are configured to urge elastically corresponding sliding members 91 upward. Gap adjusting members 93 are interposed between carriage body 90 and sliding members 91. Sliding members 91, coil springs 92, and gap adjusting members 93 are assembled on both sides of carriage body 90 with respect to the medium feeding direction in correspondence with guide rails 43 and 44. As these elements are similar in construction on both sides, the following description is based on guide rail 44, which is disposed on the downstream side with respect to the medium feeding direction.

Figure 11:
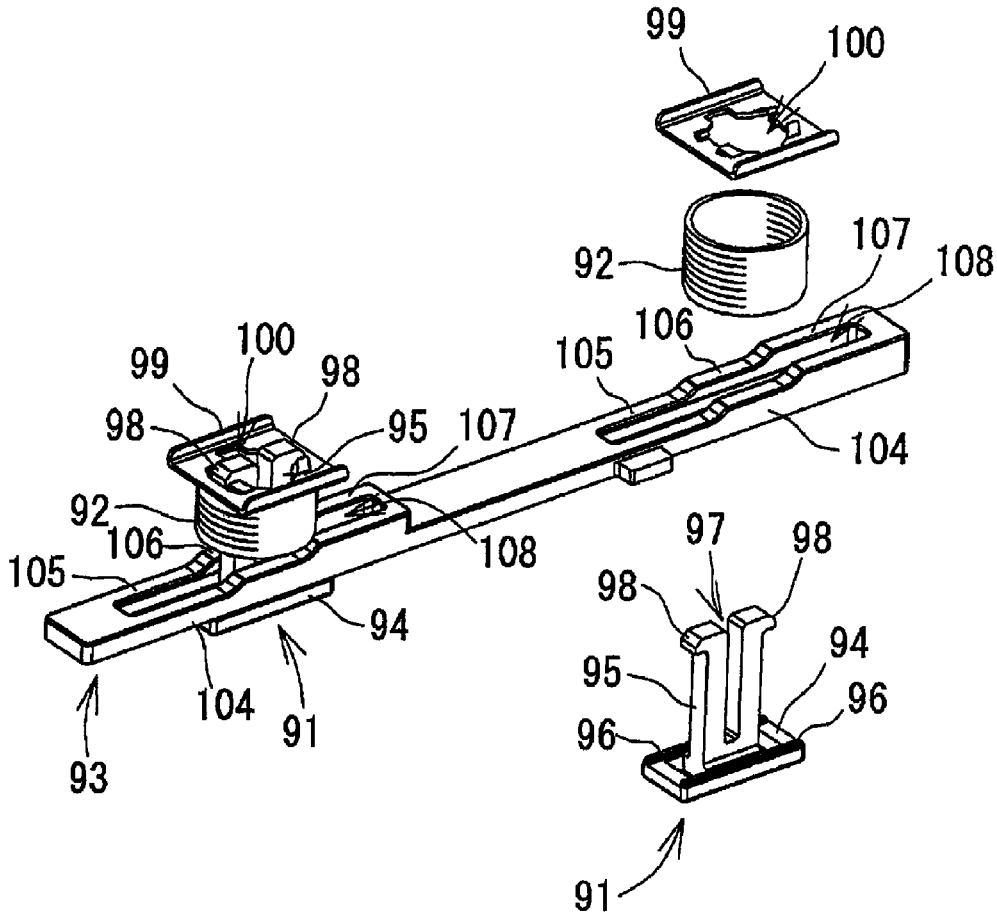
FIG. 11 is an exploded perspective view showing a sliding member, a coil spring, and a gap adjusting member.

As shown in FIG. 11, sliding member 91 comprises a contact plate 94 and a leg portion 95 extending from contact plate 94. Contact plate 94 slidably contacts guide rails 43, 44. Contact plate 94 is a rectangular-shaped, flat plate having substantially the same width as gap adjusting member 93. Contact plate 94 slides while a bottom surface thereof contacts guide surfaces 43A, 44A of guide rails 43, 44. A pair of projections 96 is formed along longitudinal edges on an upper surface of contact plate 94. When projections 96 evenly contact the bottom surface of gap adjusting plate 93, the bottom surface of contact plate 94 is positioned in parallel with guide surfaces 43A, 44A of guide rails 43, 44.

Leg portion 95 is a flat plate extends from a substantially central portion of the upper surface of contact plate 94 in a direction substantially orthogonal to the upper surface, and extending in the longitudinal direction of contact plate 94. Leg portion 95 is formed in a bifurcate shape having two branch portions. A guide groove 97 is formed between the two branch portions of leg portion 95, along a longitudinal direction of leg portion 95 and is open at open ends (e.g., upper side in FIG. 11) of leg portion 95. Guide groove 97 is configured to receive a support rib 103 (e.g., a supporting member) of carriage body 90, so that sliding member 91 is supported movably along guide groove 97. Engaging portions 98 are formed at the open ends of leg portion 95. Engaging portions 98 protrude outward with respect to the longitudinal direction of contact plate 94. Engaging portions 98 are configured to secure contact plate 94 in a retaining plate 99. Retaining plate 99 is formed with a through hole 100 into which leg portion 95 is inserted. Through hole 100 has a width less than an outer edge around engaging portions 98. Engaging portions 98 are deformed elastically by snap fitting when the two branch portions of leg portion 95 are pressed inward. When deformed engaging portions 98 are inserted into through hole 100 of retaining plate 99 and when pressure applied inwardly is released, engaging portions 98 elastically return to their original positions and protrude outward from the edge of through hole 100. With engaging portions 98, contact plate 94 is secured to retaining plate 99, so that leg portion 95 does not come off through hole 100.

As shown in FIG. 10, supporting members 101 are disposed on the downstream side of carriage body 90 with respect to the medium feeding direction. Supporting members 101 are spaced apart in a direction in which carriage 38 slides (e.g., in left-right direction in FIG. 10). Each supporting member 101 supports sliding member 91, so that sliding member 91 may move vertically. Supporting member 101 has a downward recessed portion formed therein. The recessed portion of supporting member 101 has an inside diameter slightly greater than that of coil spring 92. Supporting member 101 comprises a through hole 102 formed herein and support rib 103 at a bottom surface of the recessed portion. Leg portion 95 of sliding member 91 inserts into through hole 102, and support rib 103 engages guide groove 97 of sliding member 91. When support rib 103 engages guide groove 97 of sliding member 91, sliding member 91 is supported by supporting member 101, so as to move vertically along guide groove 97.

As shown in FIGS. 10 and 11, gap adjusting member 93 is a long narrow flat plate, and is interposed between sliding members 91 and support ribs 103. Gap adjusting member 93 is formed with a pair of adjustment portions 104 spaced apart in a longitudinal direction of gap adjusting member 93. Each adjustment portion 104 has three layers of thickness (e.g., up-down direction in FIG. 10) changing in a direction in which gap adjusting member 93 slides. In detail, a thin portion 105, a medium portion 106, and a thick portion 107 are formed adjacent to each other, so that the layers of thickness of adjustment portion 104 change gradually in one direction. Each upper surface of thin portion 105, medium portion 106, and thick portion 107 is a horizontal surface, and a length of each upper surface is slightly longer than that of leg portion 95 of sliding member 91. Each upper surface is connected with an inclined surface, so that the layers change gently.

Each adjustment portion 104 comprises a long hole 108 formed therein in a substantially central portion with respect to the width of gap adjusting member 93. Long hole 108 is open through thin portion 105, medium portion 106, and thick portion 107. The width of long hole 108 is slightly greater than the thickness of leg portion 95 of sliding member 91. Leg portion 95 inserts into long hole 108. The open ends of leg portion 95 inserted into long hole 108 then insert into through hole 102 of corresponding supporting member 101 of carriage body 90, as shown in FIG. 10. Support rib 103 engages guide groove 97 of leg portion 95. As shown in FIGS. 10 and 11, engaging portions 98 of leg portion 95 are secured to retaining plate 99.

Coil springs 92 are interposed between corresponding retaining plates 99 and supporting members 101. Each coil spring 92 applies an upwardly urging force to corresponding retaining plate 99. The urging force acts on sliding member 91 via retaining plate 99, and sliding member 91 is urged elastically to its top position within a range of vertical movement allowed by support rib 103. As gap adjusting member 93 is interposed between support ribs 103 and contact plates 94 of sliding members 91, each sliding member 91 is moved downward against the urging force, only by the thickness of adjustment portion 104 of gap adjusting member 93. As gap adjusting member 93 comprises elongated holes 108 formed in adjustment portions 104, gap adjusting member 93 is slidable with leg portions 95 of sliding members 91 inserted in elongated holes 108. As gap adjusting member 93 slides, the layers in the thickness of each adjustment portion 104 located between corresponding support rib 103 and contact plate 94 change, and, thus, the position of each sliding member 91 change vertically.

Each leg portion 95 is disposed on a substantially central portion of contact plate 94 of sliding member 91, and is inserted into elongated hole 108 of gap adjusting member 93. With this structure, the urging force of each coil spring 92 acts on the substantially central portion of contact plate 94, so that the positions of sliding members 91 and gap adjusting member 93 are stabilized in relation to the urging force of coil spring 92. The urging force of coil spring 92 is adjusted to such a degree as to suppress the turning moment produced when sliding member 91 slides on the upper surface of guide rails 43, 44 and as to allow gap adjusting member 93 to slide.

Each sliding member 91 is placed in position with respect to the direction in which gap adjusting member 93 slides when support rib 103 engages guide groove 97 of the portion 95. Further, sliding member 91 is disposed in position with respect to the medium feeding direction in which leg portion 95 is inserted into elongated hole 108 of adjustment portion 104 of gap adjusting member 93. When contact plate 94 comes in contact with the bottom surface of gap adjusting member 93, a sliding surface (e.g., a bottom surface) of contact plate 94 is disposed in position in parallel with the upper surface of guide rails 43, 44. In this manner, when sliding member 91 moves vertically, torsion and rotation are prevented, such that carriage 38 may be supported horizontally on guide rails 43, 44. As each support rib 103 supports corresponding sliding member 91 so as to move vertically and contact gap adjusting member 93, an arrangement may be made, such that a width required for carriage 38 to move reciprocally is reduced, and sliding member 91 is movable vertically.

As shown in FIGS. 8 and 10, gap adjusting member 93 interposed between sliding members 91 and support ribs 103 has a length, such that both ends thereof, with respect to the direction in which gap adjusting member 93 slides, protrude from carriage body 90. When each end of gap adjusting member 93 contacts the corresponding one of contact portions 109, 110 (FIG. 4) formed by cutting and raising at both ends of guide rails 43, 44, gap adjusting member 93 slides and is changed positionally relative to carriage body 90. A member to bring each end of gap adjusting member 93 into contact is not limited to contact portions 109, 110. Such a contact member may be formed by cutting and raising at a predetermined position of each of guide rails 43, 44. An apparatus frame may be used as such a contact member. Such a contact member may be disposed in a predetermined position.

As shown in FIGS. 8 and 9, sliding members 91, coil springs 92, and gap adjusting members 93 are disposed on both sides of carriage body 90 with respect to the medium feeding direction. Carriage body 90 is provided with supporting members 101 configured to support corresponding sliding members 91. As shown in FIG. 8, two sliding members 91 are disposed on the downstream side of carriage body 90 with respect to the medium feeding direction. Two sliding members 91 are configured to be moved vertically past the position in which gap adjusting member 93 slides. One sliding member 91 is disposed on the upstream side of carriage body 90. To vertically move the sliding member 91, adjustment portion 104 is formed in a central portion of gap adjusting member 93.

Each gap adjusting member 93 disposed on the upstream and downstream sides of carriage body 90 is designed such as to maintain corresponding sliding member 91 at the same level. Thus, the position of each gap adjusting member 93, which is changed upon contact with contact portions 109, 110 at one of each end of gap adjusting member 93 during reciprocal movement of carriage 38, is determined, such that three sliding members 91 maintain carriage body 90 at the same level on both the upstream and downstream sides with respect to the medium feeding direction. In other words, carriage body 90 is maintained in parallel with guide surfaces 43A, 44A of guide rails 43, 44, so that carriage body 90 is moved vertically while remaining recording head 39 mounted on carriage body 90 placed horizontally. Thus, a horizontal gap between recording head 39 and a recording medium on platen 42 is maintained in an area in which an image is formed, so that the image may be recorded accurately. The number of sliding members 91 may be changed as appropriate. For example, two sliding members 91 may be disposed on the upstream side of carriage body 90 with respect to the medium feeding direction, as with the downstream side.

As shown in FIG. 9, supporting portions 111 are formed on carriage body 90 inside sliding members 91 disposed on both upstream side and downstream side with respect to the medium feeding direction. Supporting portions 111 protrude downward from a bottom surface of carriage body 90. When sliding members 91 are inserted most deeply in carriage body 90, supporting portions 111 contact guide surfaces 43A, 44A of guide rails 43, 44, so that the height of carriage body 90 is determined.

As shown in FIG. 9, an L-shaped member 112 extends downward from the bottom surface of carriage body 90 located on the downstream side with respect to the medium feeding direction, and bends inward to form a hook shape. When carriage 38 is placed on guide rails 43, 44, a hook point of L-shaped member 112 is disposed on the lower surface over the edge of guide rail 44. There is a clearance between the hook point of L-shaped member 112 and the lower surface of guide rail 44. When carriage 38 is floated from guide rail 44, the hook point of L-shaped member 112 contacts the lower surface of guide rail 44 to prevent L-shaped member 112 from floating further. With the L-shaped member 112, carriage 38 is engaged with guides rail 43, 44 having vertical play.

Control part 71 controls the reciprocal movement of carriage 38, as structured above, in order to change the position of each gap adjusting member 93 in contact with contact portions 109, 110.

As shown in FIG. 4, carriage 38 with recording head 39 is disposed in such a manner as to straddle a pair of guide rails 43 and 44, and is moved reciprocally by control part 71 in a direction perpendicular to the medium feeding direction. When carriage 38 is moved reciprocally, ink droplets are selectively ejected from recording head 39 based on a control signal from control part 71 to form a desired image on a recording medium being fed onto platen 42.

Carriage 38 with recording head 39 is supported at a predetermined height above guide surfaces 43A and 44A of guide rails 43 and 44 by supporting portions 111 or sliding members 91 of carriage body 90. This height is selected by control part 71 according to thickness of a recording medium, such as a sheet of paper and an envelope, and the image resolution. In this embodiment, as described above, the height of carriage 38 is changed in three positions according to the layers in the thickness of adjustment portion 104 of gap adjusting member 93.

Control part 71 moves carriage 38 reciprocally and selectively brings an end of gap adjusting member 93 in contact with one of contact portions 109 and 110 formed on opposite ends of guide rail 44. Control part 71 selects the height of carriage 38 from the three positions according to the thickness of a recording medium and the image resolution, which are indicated in information transmitted from the printer driver, for example, to multifunction apparatus 1. Generally, when the recording medium is heavy paper or an envelope, control part 71 raises the height of carriage 38 in order to separate recording head 39 from platen 42. When the image resolution is high, the size of ink droplets to be ejected from recording head 39 is reduced, and, thus, control part 71 lowers the height of carriage 38 in order to bring recording head 39 near to platen 42. In this way, the conditions to select the height of carriage 38 are stored beforehand in ROM 73 in correspondence with the thickness of a recording medium and the image resolution.

In this embodiment, the height of carriage 38 normally is set in the middle of the three positions, as shown in FIGS. 9 and 10. The middle height of three positions indicates that middle portion 106 of adjustment portion 104 of gap adjusting member 93 is interposed between support rib 103 and contact plate 94 of sliding member 91. In this state, as shown in FIG. 9, the lower surface of contact plate 94 protrudes downward further than support portion 111 of carriage body 90, and carriage 38 is maintained at the middle height of the three positions by sliding member 91. In this state, a distance from the lower surface of contact plate 94 (i.e., guide surface 44A of guide rail 44) to the lower surface of recording head 39 is identified as D1, and a distance from the lower surface of recording head 39 to the upper surface of platen 42 is identified as D2. In FIGS. 9-15, guide rails 43, 44 and platen 42 are not shown.

Control part 71 rotates CR motor 80 in a predetermined direction in order to move carriage 38 to a side on which cap 58 is disposed (e.g., to the right side of FIG. 4) to raise the height of carriage 38. When carriage 38, which is moved slidably to cap 58 on guide rails 43, 44, reaches a position immediately above cap 58, cap 58 moves upward and clings to the lower surface of recording head 39. Then, carriage 38 floats slightly above guide rails 43 and 44. At this time, as carriage 38 is connected to guide rail 44 by L-shaped member 112, it is not completely separated from guide rail 44. Thus, carriage 38 does not come off from guide rail 43 and 44.

Figure 12:
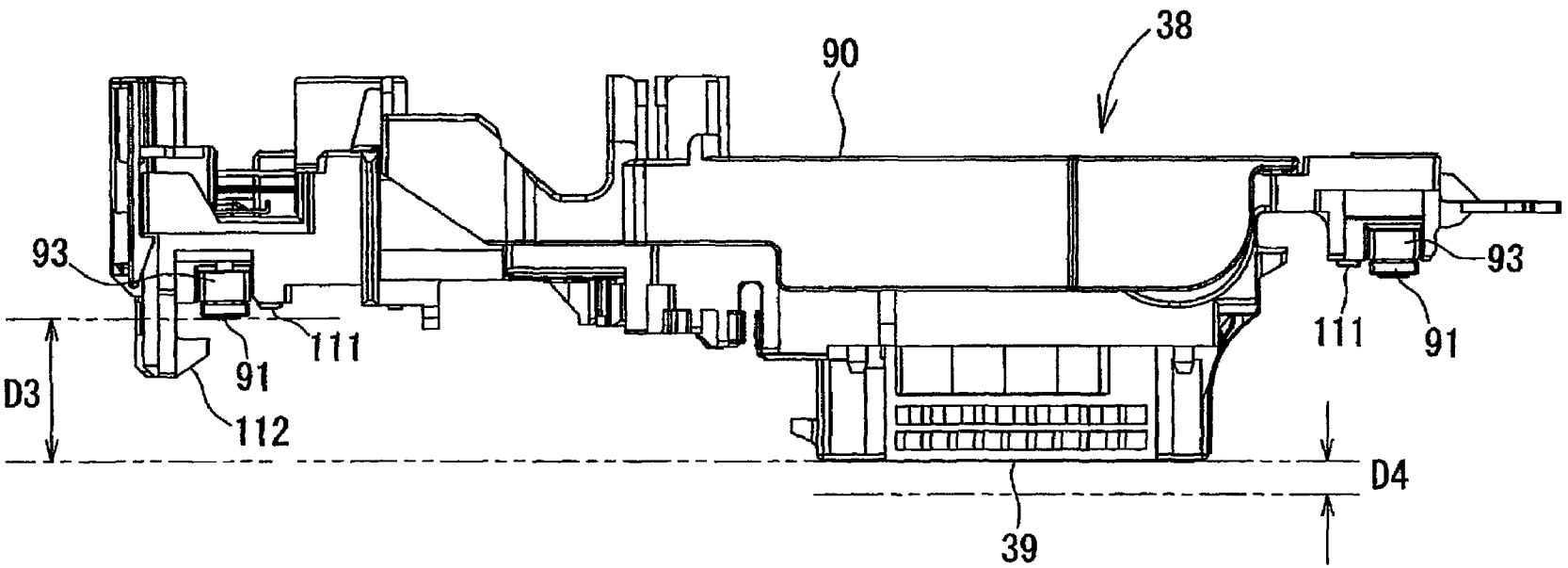
FIG. 12 is a right side view of the carriage.
Figure 13:
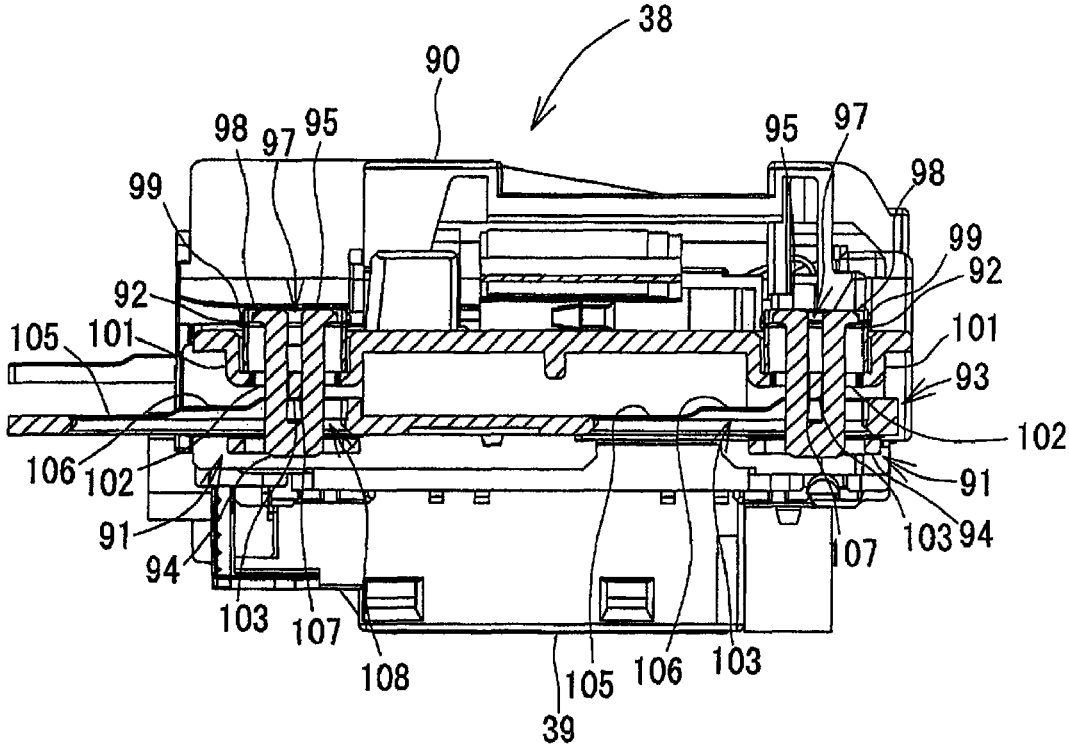
FIG. 13 is a cross-sectional view of the carriage taken along a line XI-XI of FIG. 8.

When carriage 38 is moved above cap 58, the end of each gap adjusting member 93, which protrudes outward from carriage 38, contacts contact portion 109 (e.g., on the right side of FIG. 4). When carriage 38 is further moved, as shown in FIG. 13, gap adjusting member 93 slides leftward relative to carriage body 90, and the end of gap adjusting member 93 is withdrawn within carriage body 90. At this time, thick portion 107 of adjustment portion 104 of gap adjusting member 93 is interposed between support rib 103 and contact plate 94 of sliding member 91. In this state, as shown in FIG. 12, the lower surface of contact plate 94 protrudes downward further than support portion 111 of carriage body 90, and carriage 38 is maintained at the greatest height of three position by sliding member 91.

Carriage 38 is moved reciprocally on guide rails 43 and 44 upon the receipt of a driving force of CR motor 80. By the inertia of carriage 38, gap adjusting member 93 slides in a direction to spread the distance between support rib 103 and contact plate 94, against the urging force of coil spring 92 and the weight of carriage 38. As described above, when cap 58 clings to the lower surface of recording head 39, carriage 38 floats slightly above guide rails 43 and 44. Thus, the weight of carriage 38 does not cause sliding of gap adjusting member 93. As a result, torque required for CR motor 80 to slide the cap adjusting member 93 is reduced.

In this state, the distance from the lower surface of contact plate 94 or guide surface 44A of guide rail 44 to the lower surface of recording head 39 is identified as D3, and the distance from the lower surface of recording head 39 to the upper surface of platen 42 is identified as D4. When the lower surface of sliding member 91 protrudes downward further than supporting portion 111 of carriage body 90, carriage 38 is moved vertically upward from guide rails 43, 44, and distance D1 becomes greater than distance D3. As a result, the lower surface of recording head 39 leaves platen 42, and distance D2 becomes less than distance D4. When a thick recording medium is fed onto platen 42, the recording medium is prevented from contacting recording head 39. Variations of a distance from recording head 39 to a recording medium are changed with thickness of the recording medium, i.e., gap variations may be adjusted by the height of carriage 38.

Figure 14:
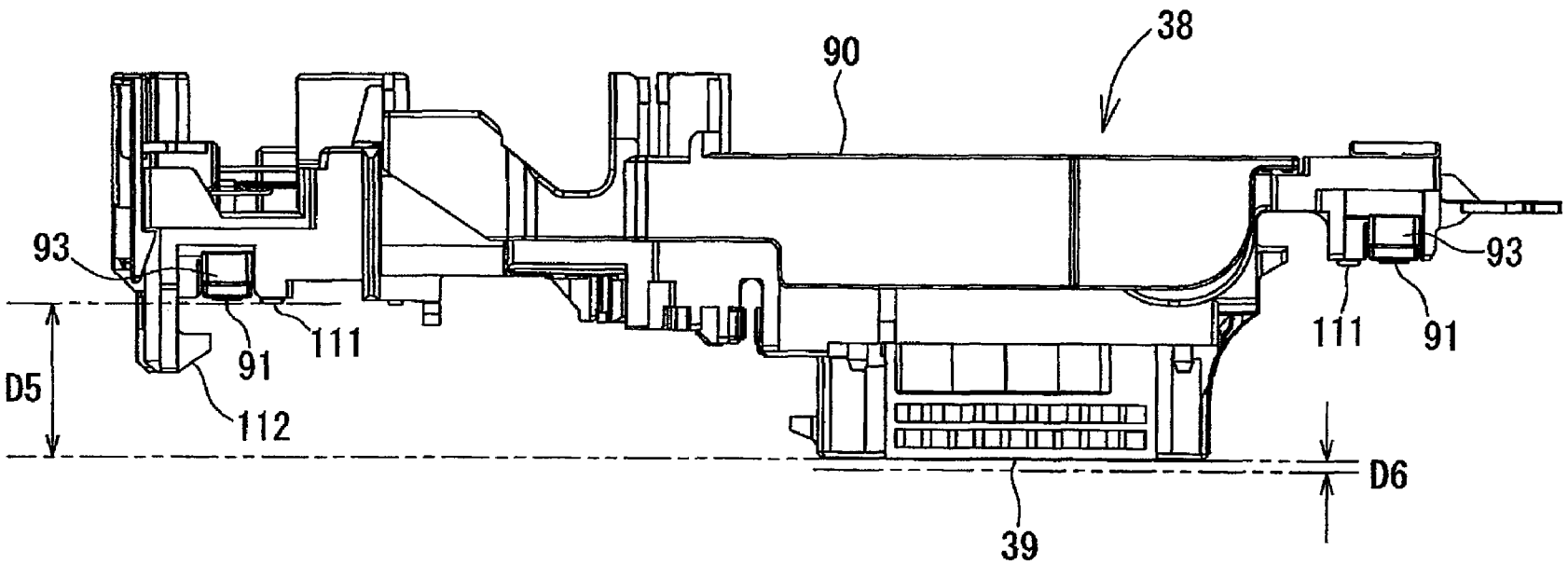
FIG. 14 is a right side view of the carriage.
Figure 15:
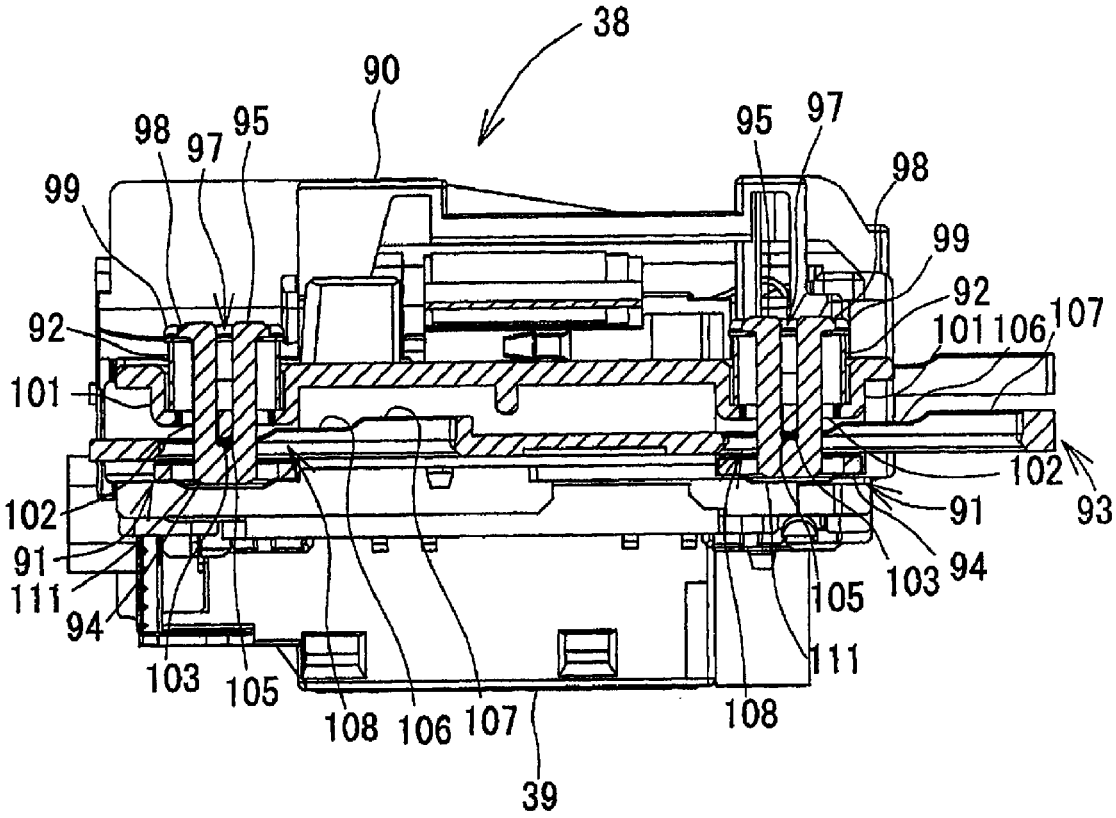
FIG. 15 is cross-sectional view of the carriage taken along a line XI-XI of FIG. 8.

To lower the height of carriage 38, control part 71 rotates CR motor 80 in a predetermine direction to move carriage 38 to waste ink tray 57 (e.g., to the left side of FIG. 4). When carriage 38, which slides to waste ink tray 57 on guide rails 43, 44, moves to one end of guide rails 43, 44, the other end of each gap adjusting member 93, which protrudes outwardly from carriage 38, contacts contact portion 110. When the other end of gap adjusting member 93 contacts contact portion 110, carriage 38 is moved further, as shown in FIG. 15, gap adjusting member 93 slides rightwardly relative to carriage body 90, and the other end of gap adjusting member 93 is withdrawn within carriage body 90. At the same time, thin portion 105 of adjustment portion 104 of gap adjusting member 93 is interposed between support rib 103 and contact plate 94 of sliding member 91. As shown in FIG. 14, the lower surface of contact plate 94 is withdrawn upward more than support portion 111 of carriage body 90, and carriage 38 is maintained at the lowest height of the three positions by support portion 111.

Distance from the lower surface of support portion 111 or guide surface 44A of guide rail 44 to the lower surface of recording head 39 is identified as D5, and a distance from the lower surface of recording head 39 to the upper surface of platen 42 is identified as D6. When sliding member 91 is withdrawn within carriage body 90, carriage 38 is moved vertically downward toward guide rails 43, 44, and distance D1 becomes less than distance D5. As a result, the lower surface of recording head 39 moves near platen 42, and distance D2 becomes greater than distance D6. When distance D2 is greater than distance D6, the position of recording head 39 is suitable for image recording with high resolution by ejecting small ink droplets from recording head 39. In this embodiment, when sliding member 91 is withdrawn within carriage body 90, carriage 38 is supported by support portion 111 of carriage body 90 on guide rails 43, 44. Nevertheless, support portion 111 may not be provided. Sliding member 91 may support carriage body 90 at any height on guide rails 43, 44.

Figure 16:
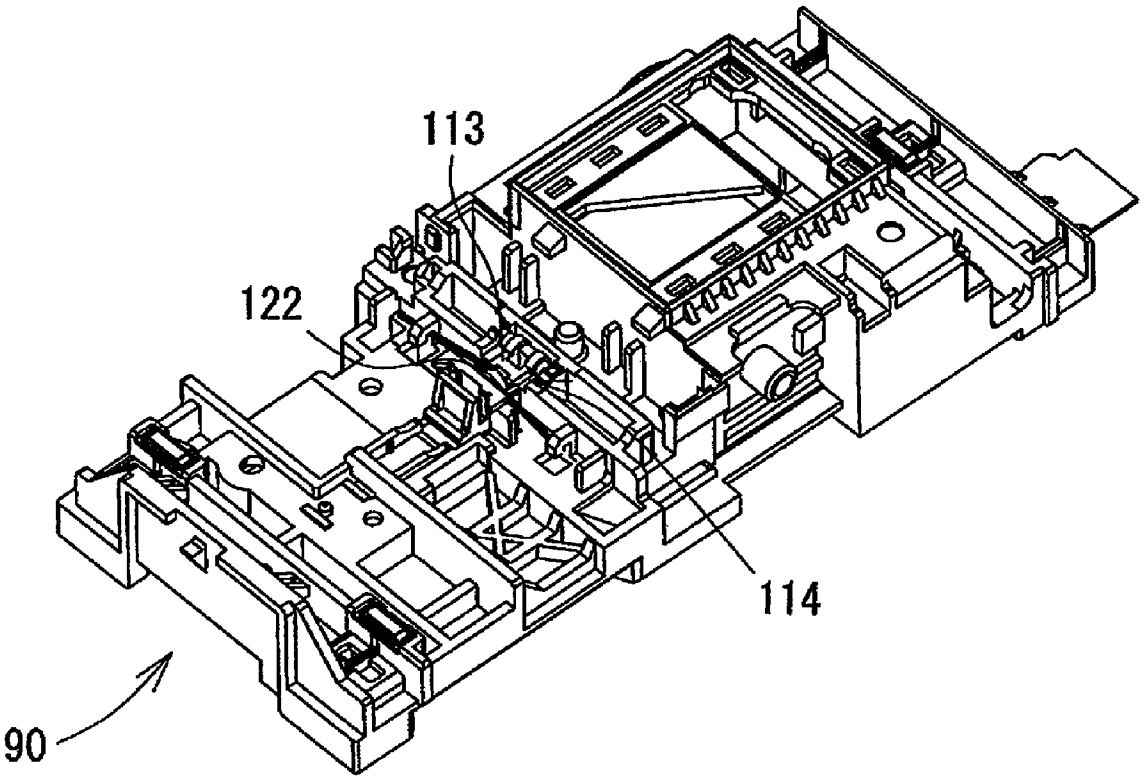
FIG. 16 is a perspective view showing a bottom surface of a carriage body.

A connection between carriage 38 and timing belt 49 is described below with reference to FIGS. 4 and 16-19. In FIG. 16, recording head 39 and gap adjusting member 93 to be mounted on carriage body 90 are not shown.

As shown in FIG. 4, carriage 38 is placed on guide rails 43, 44 so as to cover timing belt 49 of belt drive mechanism 46 disposed on guide rail 44. Thus, the bottom surface of carriage body 90 faces timing belt 49. To connect carriage body 90 and timing belt 49, a belt holder 113 (FIG. 16) is disposed on the bottom surface of carriage body 90.

Figure 17:
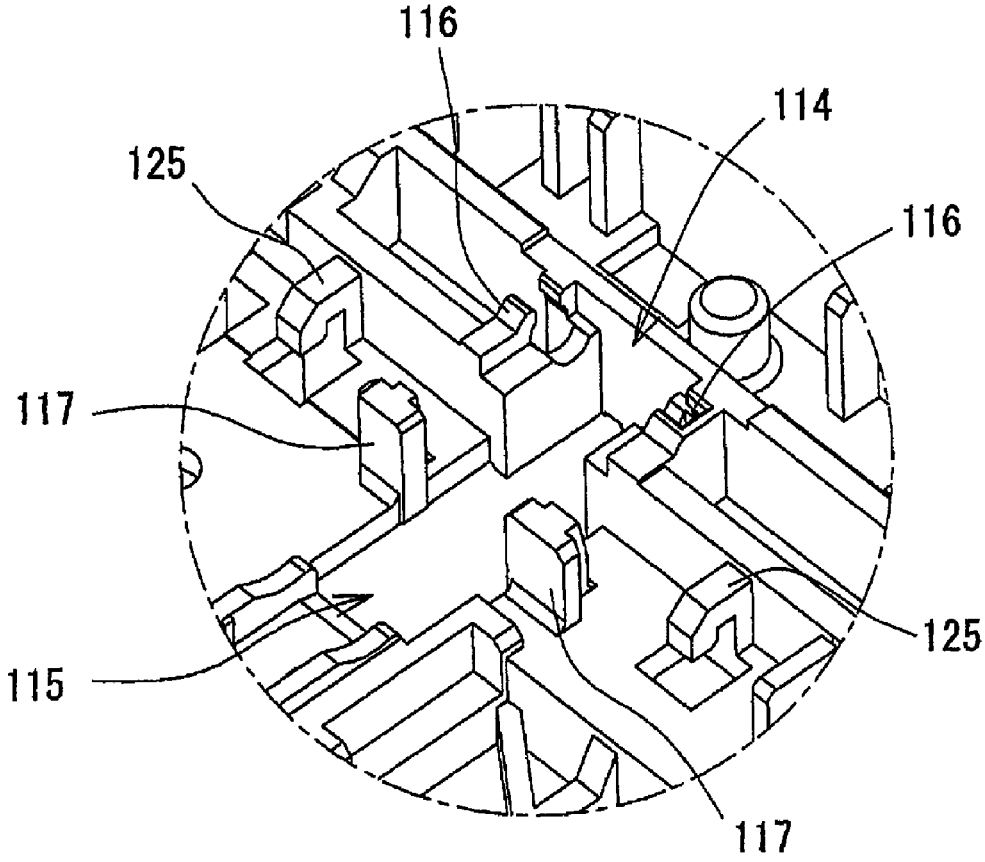
FIG. 17 is an enlarged perspective view showing a structure of a holder receiving portion of a carriage body.

As shown in FIGS. 16 and 17, a holder receiving portion 114 is formed on the bottom surface of carriage body 90. Holder receiving portion 114 includes a recessed portion 115 into which belt holder 113 is inserted. Recessed portion 115 is formed to match an outside shape of belt holder 113. As belt holder 113 is substantially box-shaped in this embodiment, recessed portion 115 also is substantially box-shaped. In this embodiment, recessed portion 115 is formed as a hole vertically passing through the bottom surface of carriage body 90. Nevertheless, recessed portion 115 may not pass through the bottom surface of carriage body 90.

Figure 19:
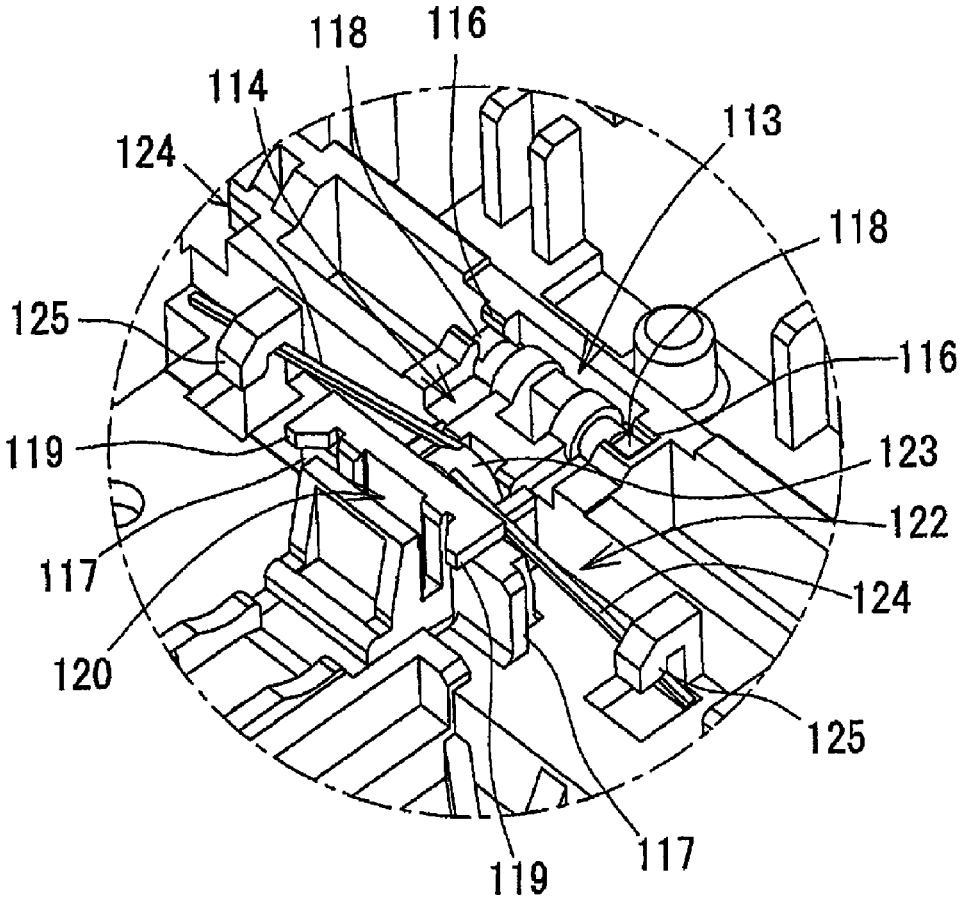
FIG. 19 is an enlarged perspective view showing a structure around the holder receiving portion.

A pair of bearings 116 is disposed on one end of recessed portion 115 (e.g., on the upstream side with respect to the medium feeding direction). Bearings 116 are disposed facing each other with respect to the travel direction of carriage 38. As shown in FIG. 19, bearings 116 support a support shaft 118 of belt holder 113.

A pair of contact members 117 is disposed on the other end of recessed portion 115 (e.g., on the downstream side with respect to the medium feeding direction). Contact members 117 are disposed facing each other with respect to the travel direction of carriage 38. As shown in FIG. 19, contact members 117 contact a wing portion 119 of belt holder 113.

Figure 18:
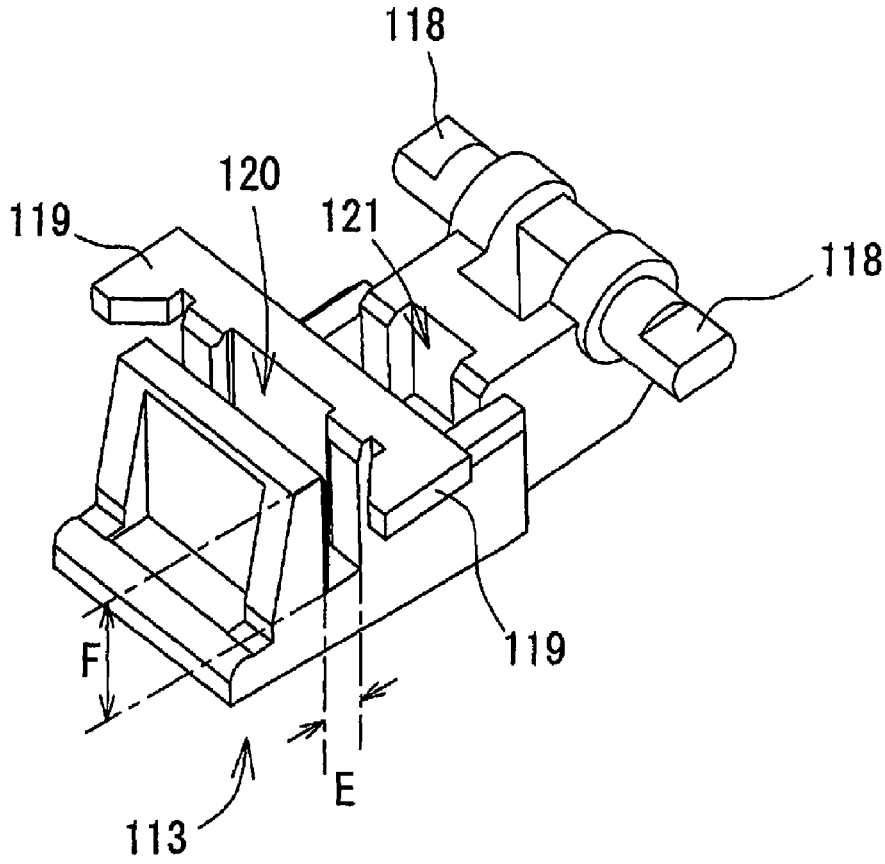
FIG. 18 is a perspective view of a belt holder.

As shown in FIG. 18, belt holder 113 is substantially box-shaped, and is formed with support shaft 118 extending horizontally on one end (e.g., on the upstream side with respect to the medium feeding direction in this embodiment). As shown in FIG. 19, when belt holder 113 is inserted in recessed portion 115 of holder receiving portion 114, support shaft 118 is inserted into bearings 116. Thus, belt holder 113 becomes rotatable on support shaft 118 relative to carriage body 90, and is configured to move in and out from the bottom surface of carriage body 90.

Wing portion 119 is formed at the other end of belt holder 113 (e.g., on the downstream side with respect to the medium feeding direction in this embodiment). Wing portion 119 is a flat, horizontally oriented plate. When belt holder 113 is rotated on support shaft 118, wing portion 119 contacts contact members 117 of holder receiving portion 114. By this contact, belt holder 113 is prevented from rotating further toward carriage body 90. Namely, a position in which belt holder 113 is rotatable toward carriage body 90 is determined by the position in which wing portion 119 contacts contact members 119.

A clip portion 120 is formed on the other end of belt holder 113. Clip portion 120 is a slit whose depth direction is vertical with respect to a lower surface (e.g., upper side in FIG. 18) of belt holder 113. Clip portion 120 is open at both sides of belt holder 113. Clip portion 120 has a width E slightly less than the thickness of timing belt 49, and a depth F greater than the width of timing belt 49. As timing belt 49 is stretched between drive pulley 47 and driven pulley 48 whose shafts are placed in the vertical direction described above, the width direction of timing belt 49 is defined in the vertical direction, and the thickness direction thereof is defined in the horizontal direction. Clip portion 120 holds timing belt 49 therein by catching timing belt 49 in its thickness direction from above. In this manner, timing belt 49 and carriage body 90 are connected via belt holder 113.

As shown in FIG. 18, a spring receiving portion 121 is formed in a substantially central portion of belt holder 113. Spring receiving portion 121 is recessed in the vertical direction from the lower surface of belt holder 113. As shown in FIG. 19, spring receiving portion 121 receives a coil portion 123 of a torsion coil spring 122 (e.g., an urging member). Torsion coil spring 122 also comprises arm portions 124 that protrude in opposite directions from coil spring 122.

As shown in FIGS. 17 and 19, a pair of L-shaped engaging members 125 is formed on the bottom surface of carriage body 90. Engaging members 125 are spaced apart from holder receiving portion 114 in the travel direction of carriage 38. Arm portions 124 of torsion coil spring 122 are retained by engaging members 125 formed on the bottom surface of carriage body 90.

As shown in FIG. 19, torsion coil spring 122 is assembled in carriage body 90 in such a manner that coil portion 123 is received in spring receiving portion 121 of belt holder 113 and arm portions 124 are retained at engaging members 125 of carriage body 90. Belt holder 113 is rotated to carriage body 90, and torsion coil spring 122 is elastically deformed. Belt holder 113 is urged elastically toward carriage body 90 by an elastic return force of torsion coil spring 122. As the rotatable position of belt holder 113 toward carriage body 90 is determined by the position at which wing portion 119 contacts contact members 117, belt holder 113 that is urged elastically is retained at rest subject to no external force. When an external force is applied to belt holder 113, belt holder 113 is rotatable against the urging force of torsion coil spring 122 so as to protrude from carriage body 90.

Figure 20:
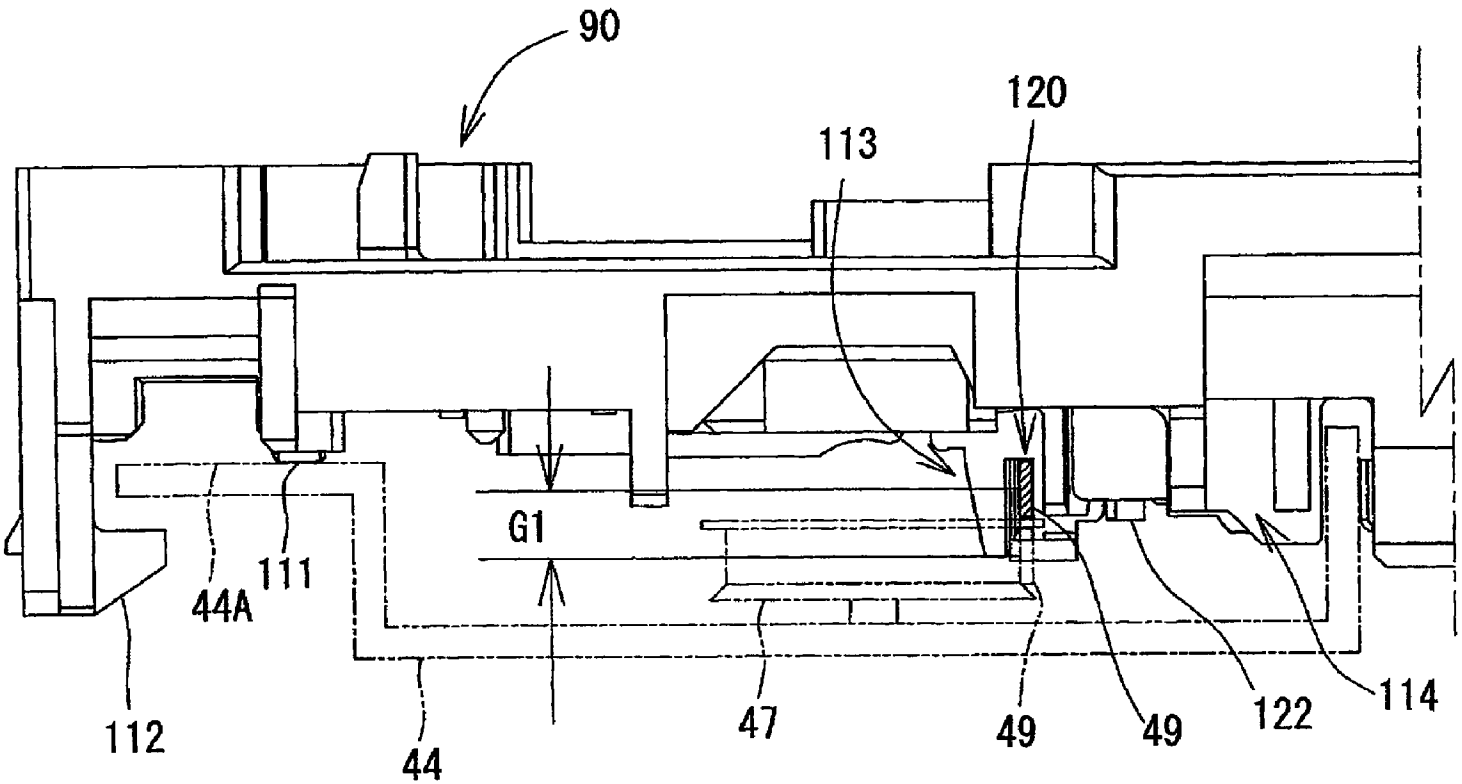
FIG. 20 is an enlarged cross-sectional view showing the belt holder of the carriage body and surrounding elements.
Figure 21:
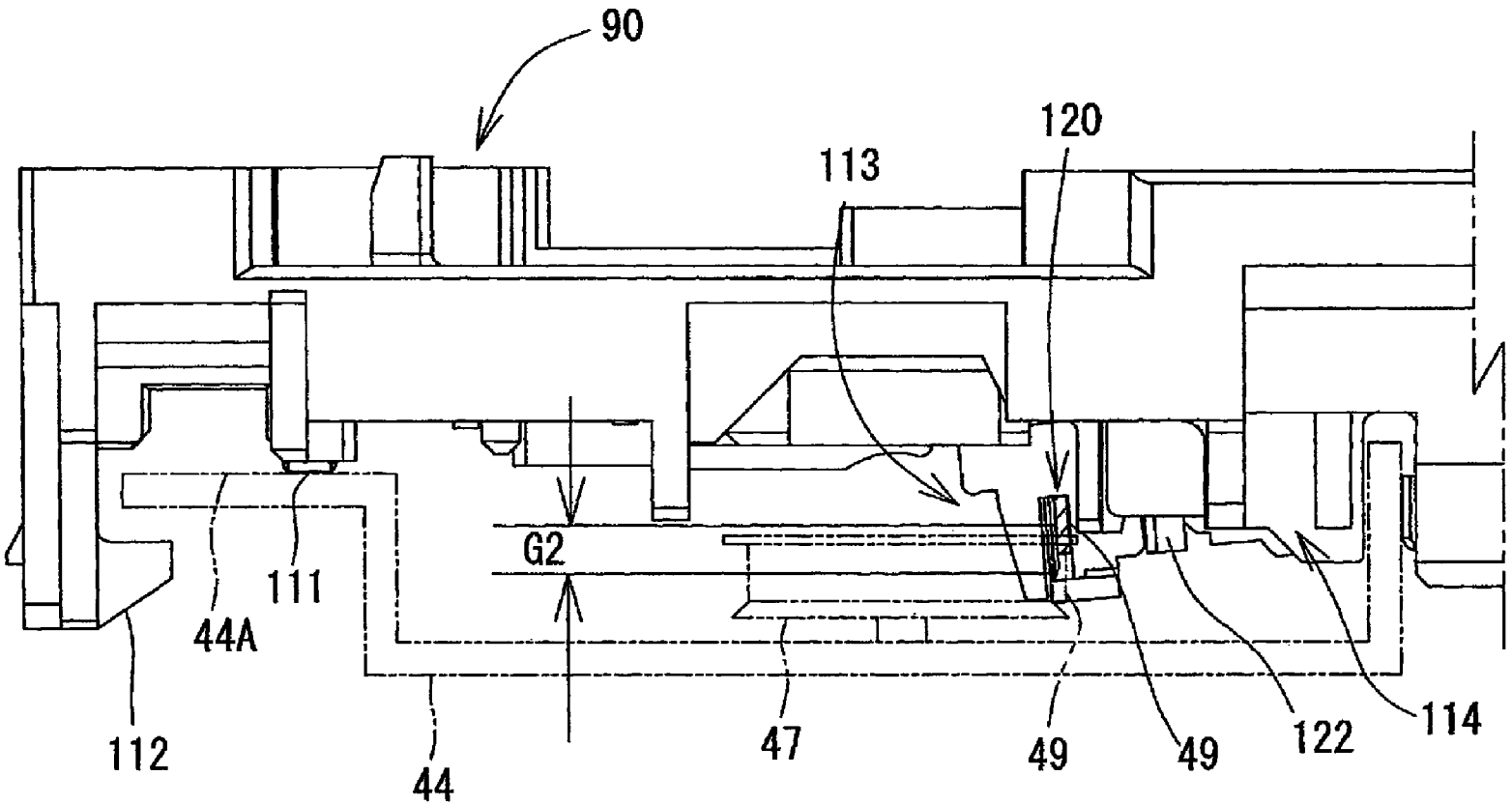
FIG. 21 is an enlarged cross-sectional view showing the belt holder of the carriage body and surrounding elements.

FIG. 20 is a side view showing a position of belt holder 113 when carriage 38 is located near a center of guide rail 44. FIG. 21 is a side view depicting a position of belt holder 113 when carriage 38 is located near drive pulley 47 on guide rail 44. In FIGS. 20 and 21, guide rail 44 and drive pulley 47 are indicated by a double dotted line, and gap adjusting member 93 of carriage 90 is not shown.

As shown in FIG. 20, belt holder 113 is mounted in holder receiving portion 114 of carriage body 90, urged by torsion coil spring 122 and rotated toward carriage body 90. In this state, clip portion 120 of belt holder 113 is located at a position higher than the position at which timing belt 49 is to be moved around drive pulley 47. Thus, timing belt 49 is held in clip portion 120, such that it is pulled upward from drive pulley 47. Here, the height of timing belt 49 is different at drive pulley 47 and clip portion 120. This height difference is identified as G1.

As belt holder 113 holds timing belt 49 by raising it by the difference G1 from drive pulley 47, the tension of timing belt 49 acts on belt holder 113. Belt holder 113 is fitted in holder receiving portion 114 of carriage body 90, and is urged by the torsion coil spring 122 toward carriage body 90. When carriage 38 is located near the center of guide rail 44, the force of torsion coil spring 122 is greater than the tension of timing belt 49 acting on belt holder 113 in the vertical direction. Thus, belt holder 113 is rotated toward carriage body 90, and the tension of timing belt 49 acts on carriage body 90 via belt holder 113. With this structure, carriage body 90 is urged to guide rail 44 thereby preventing carriage body 90 from floating (e.g., separating) from guide rail 44.

When carriage 38 is moved near drive pulley 47, the distance from drive pulley 47 to belt holder 113 is short compared with the distance when carriage 38 is located near the center of guide rail 44. Thus, as the position of timing belt 49 is changed with the short distance between drive pulley 47 and belt holder 113, the angle of inclination of timing belt 49 increases. As a result, the tension of timing belt 49 acting on belt holder 113 also increases. Namely, the tension of timing belt 49 acting on belt holder 113 in the vertical direction becomes strongest near drive pulley 47 and weakest near the center of guide rail 44.

As shown in FIG. 21, when carriage 38 moves near drive pulley 47 and the tension of timing belt 49 acting in the vertical direction increases, belt holder 113 is rotated to a direction at which belt holder 113 protrudes from carriage body 90, e.g., belt holder 113 is rotated to guide rail 44, against the urging force of torsion coil spring 122. Then, clip portion 120 moves to guide rail 44, and the height difference of timing belt 49 between drive pulley 47 and clip portion 120 becomes G2. Difference G2 is significantly less than difference G1 when belt holder 113 is rotated to carriage body 90. The height difference of timing belt 49 between drive pulley 47 and clip portion 120 becomes small between G1 and G2 near drive pulley 47, thereby preventing the tension of timing belt 49 applied in the vertical direction from excessively acting on carriage body 90 near drive pulley 47.

In FIG. 21, support portion 111 of carriage body 90 contacts guide surface 44A of guide rail 44. As shown in FIG. 14, carriage body 90 is located at the lowest position on guide rail 44. As described above, as gap adjusting member 93 slides relative to carriage body 90, sliding member 91 protrudes downward from supporting portion 111 of carriage body 90, and the height of carriage body 90 is raised (FIGS. 9 and 12). As a result, the height difference of timing belt 49 between drive pulley 47 and clip portion 120 becomes greater than G1, and the tension of timing belt 49 acting on carriage body 90 in the vertical direction also increases. When carriage 38 is moved above purge mechanism 56 and recording head 39 is covered with cap 58, carriage 38 may float from above guide rail 44. Even in this case, the tension of timing belt 49 acting on carriage body 90 in the vertical direction also increases. In theses cases, as with the foregoing, belt holder 113 is rotated toward guide rail 44 against the urging force of torsion coil spring 122, thereby preventing the tension of timing belt 49 applied in the vertical direction from excessively acting on carriage body 90.

According to multifunction apparatus 1, belt holder 113 is rotatable toward guide surface 44A of guide rail 44 relative to carriage body 90 and is urged by torsion coil spring 122 toward carriage body 90. When a relatively strong tension of timing belt 49 acts on belt holder 113, belt holder 113 is moved to guide rail 44 against the urging force of torsion coil spring 122, and the tension of timing belt 49 is reduced. Thus, the generation of excessive tension by timing belt 49 is prevented near drive pulley 47, so that timing belt 49 is prevented from being worn out on one side.

The above embodiment describes the tension of timing belt 49 and the rotational movement of belt holder 113, for example, when carriage 38 is moved near drive pulley 47. Similarly, even when carriage 38 is moved near driven pulley 47, belt holder 113 is rotated thereby preventing the generation of the excessive tension of timing belt 49.

In the embodiment, belt holder 113 is rotated on support shaft 118 toward guide rail 44 relative to carriage body 90. Nevertheless, a structure to move belt holder 113 relative to carriage body 90 is not limited to rotation. Belt holder 113 may be moved by sliding.

In the embodiment, carriage 38 comprises a gap adjustment mechanism, and the height of carriage 90 from guide rail 44 is changeable in three positions. For example, the gap adjustment mechanism may comprise gap adjusting member 93, sliding member 91, supporting rib 103, and coil spring 92. Nevertheless, the gap adjustment mechanism is optional in the structure of carriage 38 according to the embodiment of the invention. If carriage 38 comprises the gap adjustment mechanism, the gap adjustment mechanism may be structured differently. The following is a modification in the gap adjustment mechanism.

Figure 22:
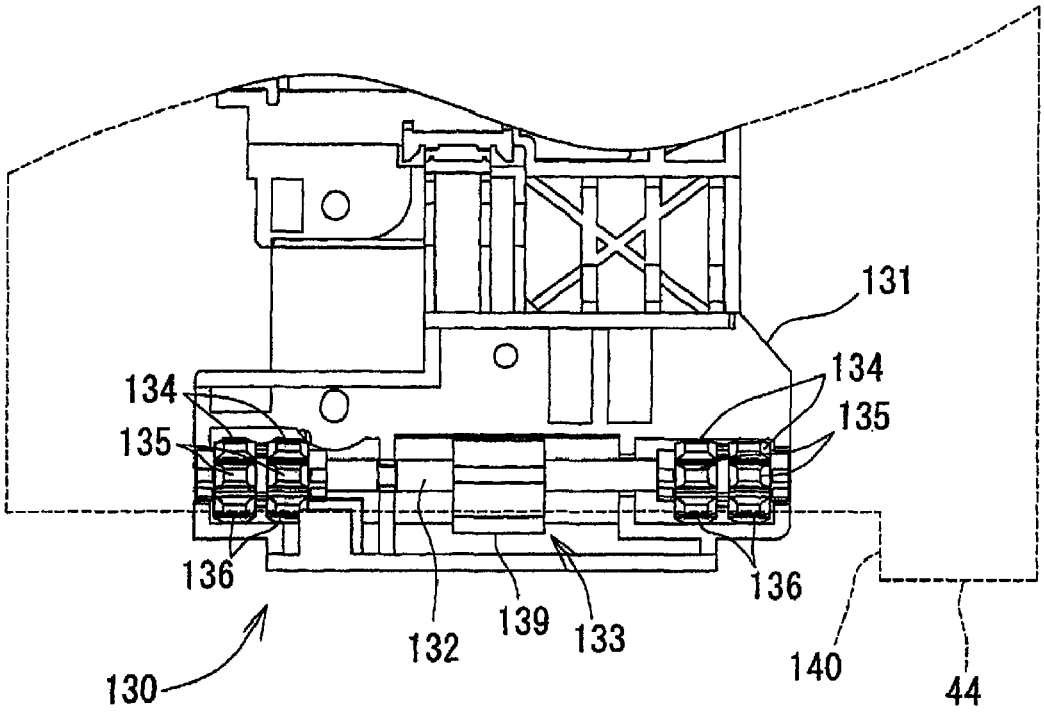
FIG. 22 is a partial bottom view of a carriage according to a modification of the invention.
Figure 23:
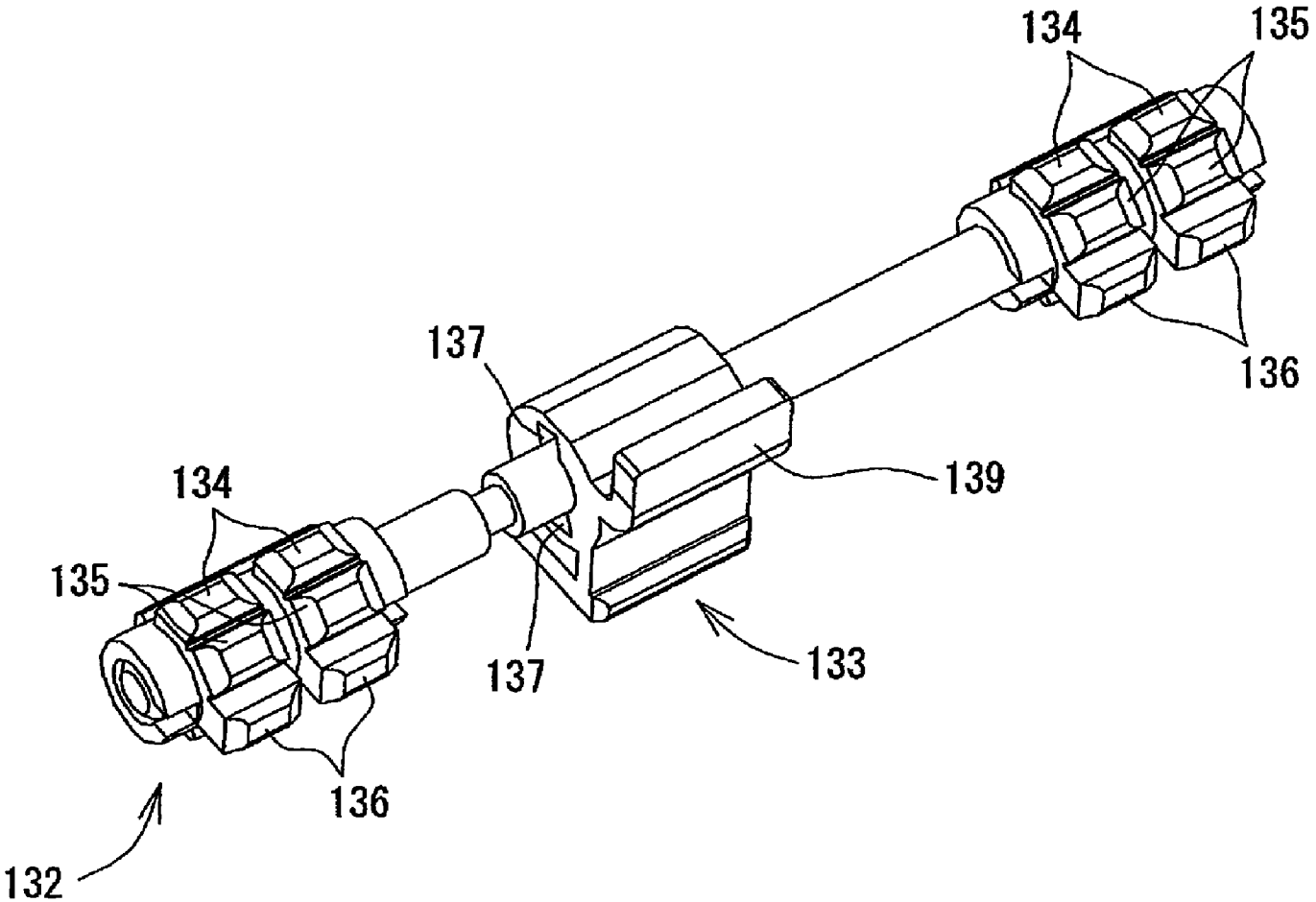
FIG. 23 is a perspective view showing a rotating shaft and a slider.
Figure 24:
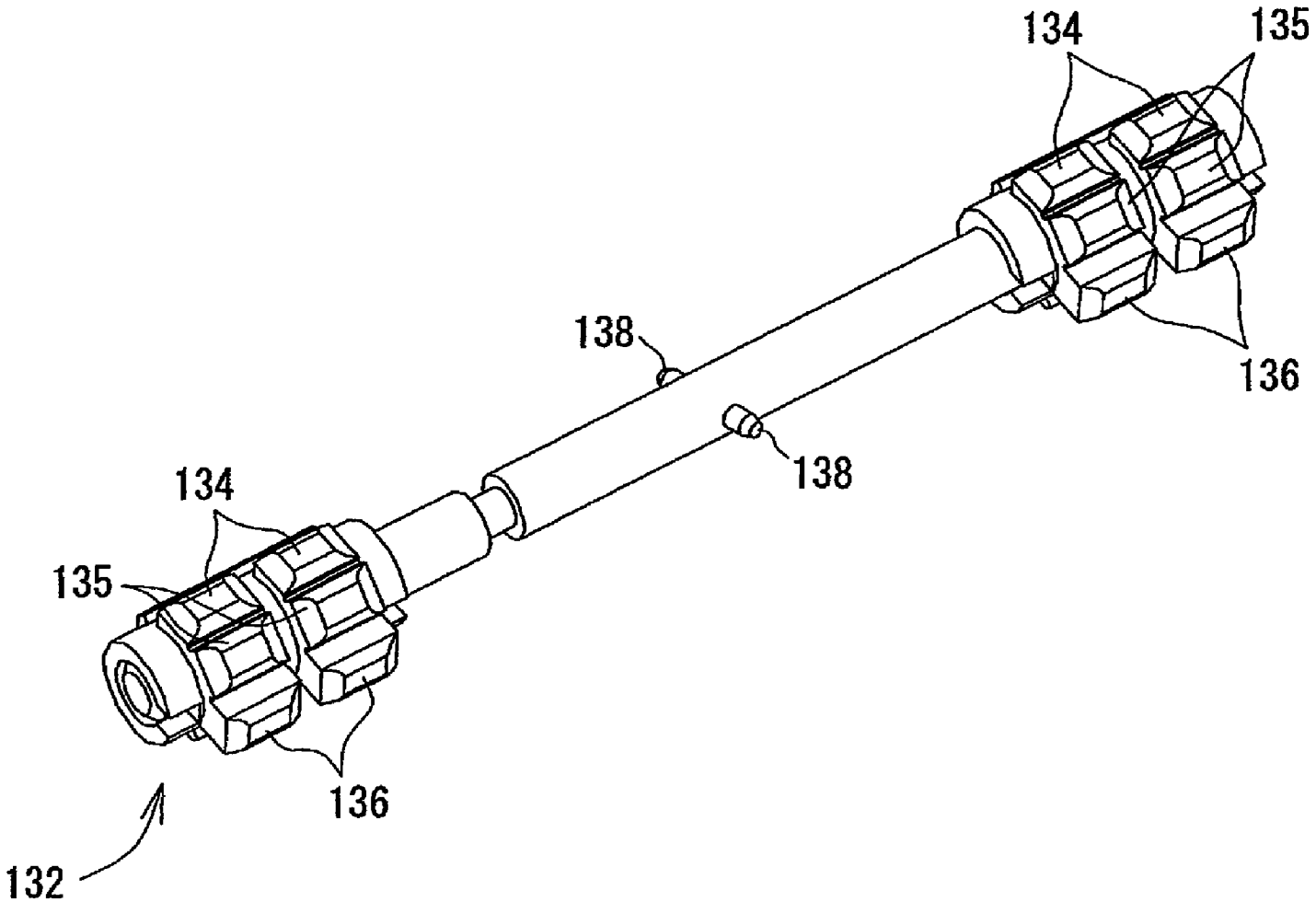
FIG. 24 is a perspective view showing the rotating shaft.
Figure 25:
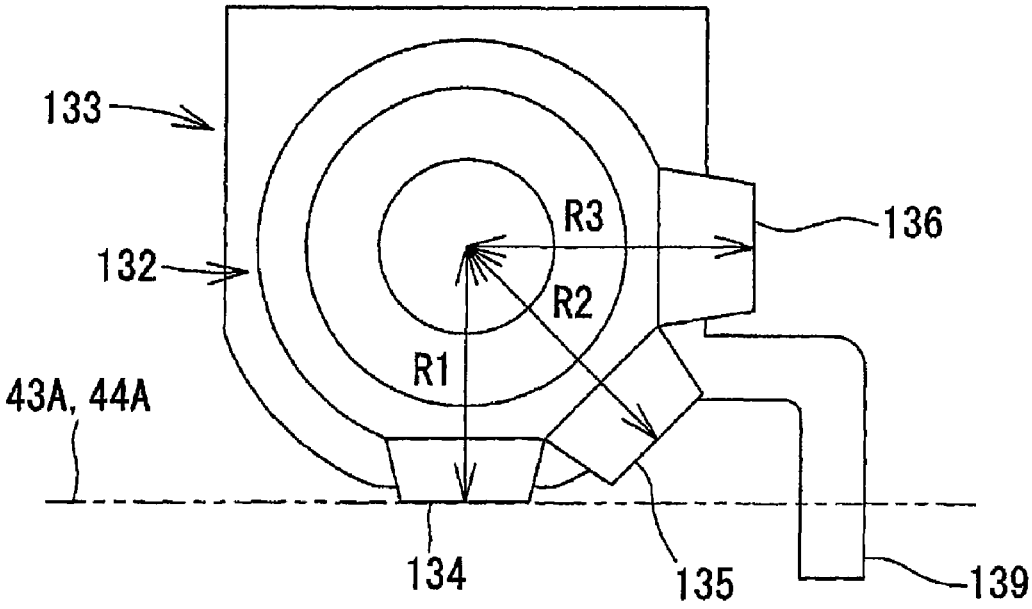
FIG. 25 is a cross-sectional view of the rotating shaft and the slider.
Figure 26:
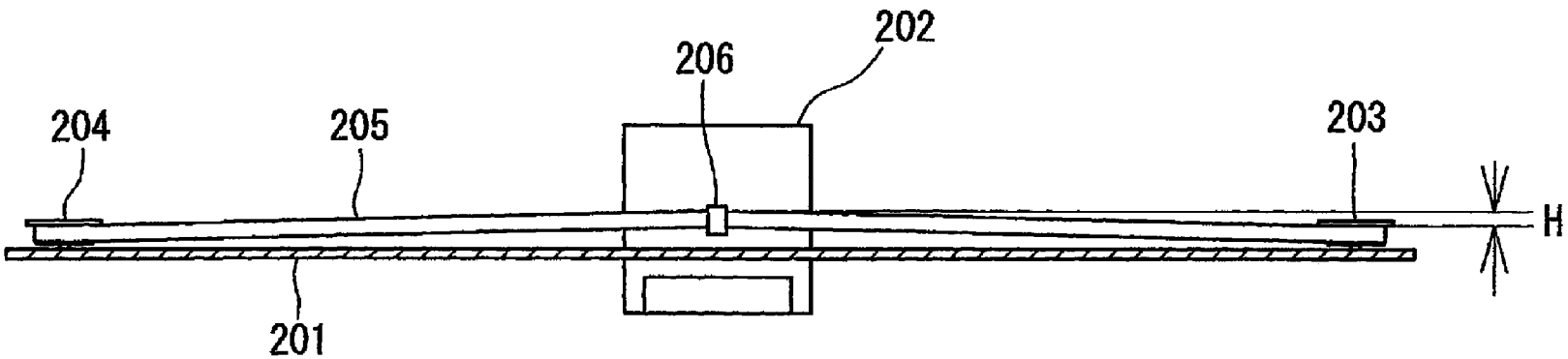
FIG. 26 is a schematic view of a related art carriage, which is moved reciprocally on a guide rail, located substantially centrally between two pulleys.
Figure 27:
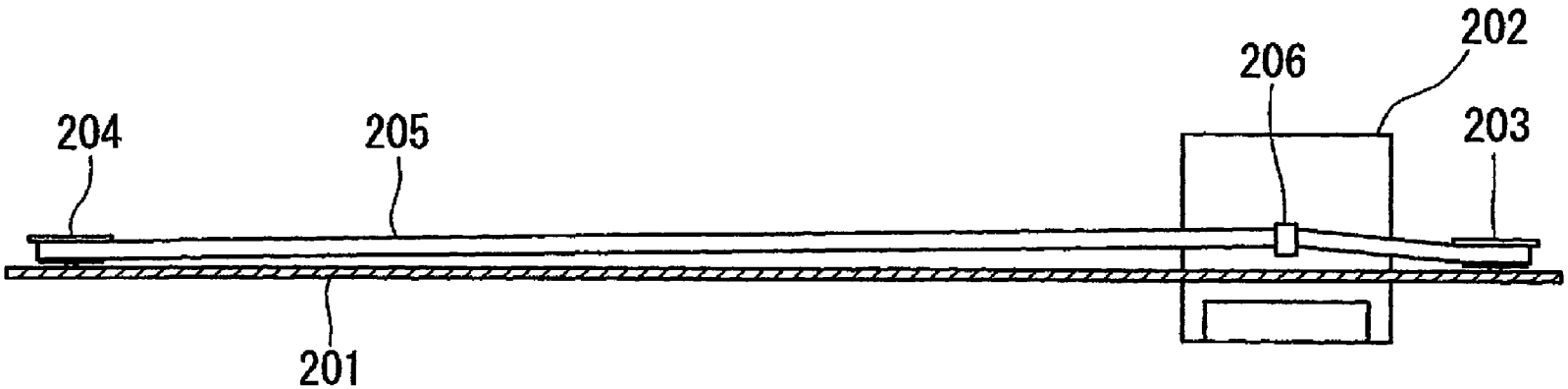
FIG. 27 is a schematic view of the related art carriage located near one of the pulleys.

A modification of the invention now is described with reference to FIGS. 22-25. FIG. 22 is a partial bottom view of a carriage 130 according to a modification of the invention. FIG. 23 is a perspective view showing a rotating shaft 132 and a slider 133. FIG. 24 is a perspective view showing rotating shaft 132. FIG. 25 is a cross-sectional view of rotating shaft 132 and slider 133. In FIG. 22, an upstream side of carriage 130, with respect to the medium feeding direction, is not shown. In the following description, elements similar to or identical with those described in the above embodiment are designated by similar numerals. Thus, the descriptions of those similar or identical elements are omitted here for the sake of brevity.

As shown in FIG. 22, carriage 130 includes a carriage body 131 with the recording head 39, a rotating shaft 132, and a slider 133. Rotating shaft 132 is configured to support carriage body 131 at a predetermined height in contact with guide rails 43, 44. Slider 133 is configured to rotate rotating shaft 132. Rotating shaft 132 and slider 133 are assembled on each side of carriage body 131 with respect to the medium feeding direction in correspondence with guide rails 43 and 44. Nevertheless, rotating shaft 132 and slider 133 are similar in construction on each side, and, thus, the following description is based on the construction on a downstream side with respect to the medium feeding direction.

As shown in FIGS. 22 and 23, rotating shaft 132 has a length substantially the same as a width of carriage 131 (e.g., left-right direction of FIG. 22). Rotating shaft 132 extends in a travel direction of carriage 130, and is rotatably disposed on a lower surface of carriage body 131. Three kinds of sliding contact members 134, 135, and 136 are disposed on each end of rotating shaft 132. Each of sliding contact members 134, 135, 136 is substantially block shaped, and protrudes in a radially outward direction from a peripheral surface of rotating shaft 132.

The three kinds of sliding contact members 134, 135, and 136 are different in width protruding in the radially outward direction of rotating shaft 132. The width is greater for each of sliding contact members 134, 135, and 136. The three kinds of sliding contact members 134, 135, and 136 are disposed side-by-side on each end of rotating shaft 132 in order with respect to a circumferential direction of rotating shaft 132. Sliding contact members 134, 135, and 136 of the same kind are disposed at the same positions on both ends of rotating shaft 132.

As shown in FIG. 22, rotating shaft 132 is supported by carriage body 131 so as to protrude either one of the three kinds of sliding contact members 134, 135, downward from carriage body 131 in the vertical direction. Carriage body 131 is supported horizontally on guide surfaces 43A and 44*a* of guide rails 43 and 44 by either one kind of sliding contact members 134, 135, or 136, which protrudes downward from carriage body 131 in the vertical direction on the upstream and downstream sides of carriage body 131 with respect to the medium feeding direction. Carriage 130 is moved reciprocally, as described above, by bringing sliding contact members 134, 135, and 136 into slidably contact with guide surfaces 43A and 44A of guide rails 43 and 44.

Slider 133 is fitted around rotating shaft 132 in a substantially middle portion thereof. Slider 133 is tubular shaped, and slidable along the peripheral surface of rotating shaft 132 in the axial direction. As shown in FIG. 23, a pair of spiral grooves 137 is recessed on an inner tubular surface of slider 133. As shown in FIG. 24, a pair of protrusions 138 is disposed in a substantially central portion, with respect to the axial direction, of the peripheral surface of rotating shaft 132 so as to protrude therefrom. As protrusions 138 are fitted in grooves 137, rotating shaft 132 and slider 133 are engaged. When slider 133 slides in the axial direction of rotating shaft 132, protrusions 138 move along grooves 137, and thus rotating shaft 132 is rotated. Namely, the sliding movement of slider 133 is transmitted to rotating shaft 132 via grooves 137 and protrusions 138 as the rotational movement.

As shown in FIG. 23, an L-shaped protrusion 139 is provided on the outer surface of slider 133. Protrusion 139 protrudes outwardly from the outer surface of slider 133. As shown in FIG. 22, when rotating shaft 132 and slider 133 are assembled in carriage body 131, protrusion 139 protrudes from the lower surface of carriage body 131. When carriage 130 slides to a predetermined position on guide rails 43 and 44, protrusion 139 contacts a contact portion 140 formed by cutting guide rails 43 and 44 partially. When carriage 130 slides further, slider 133 slides in the axial direction of rotating shaft 132.

Control part 71 controls the reciprocal movement of carriage 130 structured to cause slider 133 to contact portion 140 to change rotational position of rotating shaft 132. As shown in FIG. 25, when sliding member 134, which is provided with the shortest distance R1 measured from the center of rotating shaft 132 to the end surface of sliding member 134, slidably contacts guide surfaces 43A and 44A of guide rails 43 and 44 by carriage body 131 is supported at the lowest height of the three positions.

Control part 71 causes carriage 130 to slide in a predetermined direction on guide rails 43 and 44 so as to bring slider 133 into contact with contact portion 140 formed on guide rails 43 and 44, thereby slider 133 slides in the axial direction of rotating shaft 132. The sliding movement of slider 133 is transmitted via grooves 137 and protrusions 138 to rotating shaft 132, so that rotating shaft 132 is rotated. Thus, when rotating shaft 132 is rotated by the sliding movement of slider 133 in such a way that sliding contact members 135 contact guide surfaces 43A and 44A of guide rails 43 and 44, carriage 130 is supported at the middle height of the three positions in accordance with the distance R2 measured from the center of rotating shaft 132 to the end surface of sliding contact member 135. Similarly, when rotating shaft 132 is rotated by the sliding movement of slider 133 in such a way that sliding contact members 136 contact guide surfaces 43A and 44*a* of guide rails 43 and 44, carriage 130 is supported at the highest height of the three positions in accordance with the distance R3 measured from the center of rotating shaft 132 to the end surface of sliding contact member 136. In this manner, gap between the recording head 39 and a recording medium may be adjusted in three layers in accordance with the thickness of the recording medium. The gap adjustment mechanism may be realized with this modification of the apparatus structure.

Although the embodiment and modification of the present invention have been described in detail herein, the scope of the invention is not limited thereto. It will be appreciated by those skilled in the art that various modifications may be made without departing from the scope of the invention. Accordingly, the embodiment and modification disclosed herein are only exemplary. It is to be understood that the scope of the invention is not to be limited thereby, but is to be determined by the claims which follow.

What is claimed is:

1. An image forming apparatus comprises:

a guide rail comprising a guide surface extending in a predetermined direction;

a carriage disposed on the guide surface of the guide rail;

a recording head mounted on the carriage;

a belt drive mechanism disposed along the guide rail and configured to move the carriage reciprocally along the guide surface, the belt drive mechanism comprising a drive pulley and a driven pulley and a timing belt stretched between the drive pulley and the driven pulley, and wherein the carriage comprises:

a carriage body on which the recording head is secured;

a belt holding portion configured to hold the timing belt; and an urging member configured to urge elastically the belt holding portion in a direction away from the guide surface, wherein the belt holding portion is disposed in a position offset from a line connecting the drive pulley and the driven pulley in the direction away from the guide surface, and is movable toward the guide surface relative to the carriage body, wherein the urging member comprises a coil spring, and wherein the coil spring comprises a coil portion and an arm portion protruding from the coil portion, the coil portion is in contact with the belt holding portion and the arm portion is in contact with the carriage body.

2. The image forming apparatus according to claim 1, wherein the carriage comprises a gap adjustment mechanism configured to change a height of the carriage body relative to the guide surface.

3. The image forming apparatus according to claim 2, wherein the gap adjustment mechanism comprises:

a sliding member configured to support the carriage body to a predetermined height in contact with the guide rail;

a supporting member disposed on the carriage body and configured to support vertical movement of the sliding member;

an urging member configured to urge elastically the sliding member upward;

a gap adjusting member interposed between the sliding member and the supporting member in such a manner as to slide in a direction in which the carriage is reciprocally moved, the gap adjusting member including both ends thereof with respect to the direction where the carriage is reciprocally moved, both ends of the gap adjusting member protruding from the carriage body, the gap adjusting member configured to change a distance between the sliding member and the supporting member according to a position in which the gap adjusting member slides therebetween.

4. The image forming apparatus according to claim 2, wherein the gap adjustment mechanism comprises a rotary shaft comprising a plurality of sliding members on both ends, which are different in width protruding in a radially outward direction of the rotating shaft, and one of sliding members slidably contacts the guide rail.

5. The image forming apparatus according to claim 2, wherein the guide rail comprises a pair of guide rails spaced apart in a direction in which a recording medium is fed, the guide rails extend in a direction orthogonal to the direction in which the recording medium is fed, and the carriage is disposed on the guide rails so as to lie astride the guide rails.

6. The image forming apparatus according to claim 1, wherein the belt holding portion comprises a recessed portion and the urging member is positioned in the recessed portion.

7. An image forming apparatus comprises:

a guide rail comprising a guide surface extending in a predetermined direction;

a carriage disposed on the guide surface of the guide rail;

a recording head mounted on the carriage;

a belt drive mechanism disposed along the guide rail and configured to move the carriage reciprocally along the guide surface, the belt drive mechanism comprising a drive pulley and a driven pulley and a timing belt stretched between the drive pulley and the driven pulley, and wherein the carriage comprises:

a carriage body on which the recording head is secured;

a belt holding portion configured to hold the timing belt; and an urging member configured to urge elastically the belt holding portion in a direction away from the guide surface, wherein the belt holding portion is disposed in a position offset from a line connecting the drive pulley and the driven pulley in the direction away from the guide surface, and is movable toward the guide surface relative to the carriage body, wherein the belt holding portion comprises a support shaft, the support shaft is configured to engage the carriage body and the belt holding portion is rotatable on the support shaft.

* * * * *